US008393500B2

(12) United States Patent
Mizushima et al.

(10) Patent No.: US 8,393,500 B2
(45) Date of Patent: Mar. 12, 2013

(54) DISCHARGE CONTAINER

(75) Inventors: Hiroshi Mizushima, Tokyo (JP); Shigeo Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 195 days.

(21) Appl. No.: 12/923,930

(22) Filed: Oct. 14, 2010

(65) Prior Publication Data

US 2011/0031276 A1 Feb. 10, 2011

Related U.S. Application Data

(62) Division of application No. 11/989,237, filed as application No. PCT/JP2006/314867 on Jul. 27, 2006, now Pat. No. 8,056,767.

(30) Foreign Application Priority Data

Jul. 29, 2005 (JP) ..... 2005-222250
May 31, 2006 (JP) ..... 2006-151209
Jun. 30, 2006 (JP) ..... 2006-182302

(51) Int. Cl.
*B67D 7/76* (2010.01)

(52) U.S. Cl. ..... 222/190; 222/135; 222/137; 222/145.6; 222/321.9

(58) Field of Classification Search ..... 222/135, 222/137, 145.6, 190, 321.9, 321.7, 321.8, 222/145.5, 340, 341, 383.1, 385, 401; 239/333
See application file for complete search history.

(56) References Cited

U.S. PATENT DOCUMENTS 5,271,530 A 12/1993 Uehira et al.
5,358,149 A 10/1994 O'Neill
5,431,312 A 7/1995 Schumacher
5,443,569 A 8/1995 Uehira et al.
5,570,819 A 11/1996 Uehira et al.
5,813,576 A 9/1998 Iizuka et al.
6,053,364 A 4/2000 van der Heijden
6,119,899 A 9/2000 Iizuka et al.

(Continued)

FOREIGN PATENT DOCUMENTS

EP 0 736 462 A1 10/1996
GB 1414637 11/1975

(Continued)

OTHER PUBLICATIONS

Nov. 24, 2010 Office Action issued in U.S. Appl. No. 11/989,237.

(Continued)

*Primary Examiner* — J. Casimer Jacyna
(74) *Attorney, Agent, or Firm* — Oliff & Berridge, PLC

(57) ABSTRACT

This discharge container is a discharge container provided with a container main body, a discharge pump and a fixing cap, in which the discharge pump is provided with a cylinder member made of a large-diameter cylinder and a small-diameter cylinder, a piston member mounted on the cylinder member and a nozzle head. The piston member is provided with a piston, a poppet valve, a piston guide, an air piston, an air piston valve and a stem. The air piston is provided with an inner tube portion engaged with the outer circumference of the piston guide, an upper wall portion, and a sliding tube portion engaged with the large-diameter cylinder internally so as to slide freely. The stem is provided with a lower tube portion engaged with the upper part of the piston guide to form a gas-liquid mixing chamber including a ball valve internally at the upper part of the piston guide and also engaged with the upper inner tube of the inner tube portion so as to slide freely and a mesh ring mounted on the upper inner circumference of the air piston. The nozzle head is mounted on the outer circumference of the stem.

10 Claims, 14 Drawing Sheets

U.S. PATENT DOCUMENTS

| | | | |
|---|---|---|---|
| 6,290,104 | B1 | 9/2001 | Bougamont et al. |
| 6,290,145 | B1 | 9/2001 | Mizushima et al. |
| 6,446,840 | B2 | 9/2002 | Ophardt et al. |
| 6,536,629 | B2 | 3/2003 | van der Heijden |
| 6,612,468 | B2 | 9/2003 | Pritchett et al. |
| 6,644,516 | B1 | 11/2003 | Foster et al. |
| 6,840,408 | B1 | 1/2005 | Foster et al. |
| 2002/0000452 | A1 | 1/2002 | Iizuka et al. |

FOREIGN PATENT DOCUMENTS

| | | |
|---|---|---|
| JP | U-04-102666 | 9/1992 |
| JP | A-05-270558 | 10/1993 |
| JP | A-05-319466 | 12/1993 |
| JP | U-06-032346 | 4/1994 |
| JP | A-08-133318 | 5/1996 |
| JP | A-09-001009 | 1/1997 |
| JP | A-09-124063 | 5/1997 |
| JP | 2000-167449 | 6/2000 |
| JP | A-2005-103425 | 4/2005 |
| JP | A-2006-027654 | 2/2006 |
| JP | 2007-015693 | 1/2007 |
| TW | 274074 | 4/1996 |
| TW | 288439 | 10/1996 |
| TW | 409719 | 10/2000 |
| TW | 554917 | 9/2003 |

OTHER PUBLICATIONS

Jun. 28, 2011 Japanese Office Action issued in Application No. 2006-151209 with translation.

Nov. 19, 2009 Search Report issued in European Patent Application No. 06781778.3.

Aug. 26, 2010 extended European Search Report issued in EP 10 16 2284.

Oct. 25, 2011 Office Action issued in Japanese Patent Application No. 2006-151209 (with translation).

European Patent Office Search Report issued Mar. 28, 2011 in corresponding European Patent Application No. 11152592.9-2425.

DISCHARGE CONTAINER

CROSS-REFERENCE TO RELATED APPLICATIONS

This is a Division of application Ser. No. 11/989,237 filed Jan. 23, 2008. The disclosure of the prior application is hereby incorporated by reference herein in its entirety. The present application claims the right of priority on the basis of Patent Application No. 2005-222250 filed on Jul. 29, 2005, Patent Application No. 2006-151209 filed on May 31, 2006 and Patent Application No. 2006-182302 filed on Jun. 30, 2006, the content of which is incorporated herein by reference.

BACKGROUND

The present invention relates to a discharge container and, in particular, relates to a discharge container by which a contained liquid is discharged in a bubble form.

SUMMARY

Conventionally, there is known a discharge container which is provided with a container main body, a cylinder, a piston, a stem and a nozzle head to discharge a contained liquid in a bubble form. In the discharge container, the nozzle head is pushed down, by which the contained liquid accommodated in the container main body is sucked up and mixed with air inside a gas-liquid mixing chamber to produce bubbles in the course of passing through a mesh ring, and the thus bubbled contained liquid is discharged from a nozzle hole of the nozzle head (refer to Patent Document 1 given below, for example).

Further, for the purpose of solving such a problem that contained liquid remaining on a nozzle is dripped or the contained liquid remaining therein is denatured in a discharge container having the above-described structure, proposed is a discharge container structured so as to suck the contained liquid remaining in the nozzle into a container main body after discharge of the contained liquid (refer to the following Patent Document 2, for example).

Patent Document 1: Japanese Unexamined Patent Application, First Publication No. 9-124063

Patent Document 2: Japanese Unexamined Patent Application, First Publication No. 2006-027654

Moreover, the discharge container described in Patent Document 1 (the bubble ejecting pump of the document) is provided with a large-diameter cylinder portion, the inside of which is provided as an air chamber, and a second piston in order to feed air to a gas-liquid mixing chamber. Then, a first air suction valve is mounted on the upper part of the inner circumference at a large-diameter cylinder portion in order to suck in air from the outside of a container so as not to make a negative pressure inside a container main body. Further, in order to feed air into a gas-liquid mixing chamber, a second air suction valve is mounted on the lower face of a second large-diameter piston, which is engaged with the large-diameter cylinder portion. Therefore, a problem is posed that in the above-described discharge container, a larger number of components are required in fabricating the air suction valve of the discharge pump, thus resulting in an increase in production cost.

Further, in the discharge container described in Patent Document 1 above, a pump head in which a bubble-foaming unit is internally mounted is mounted on the upper part of a stem in which a gas-liquid mixing chamber is internally formed. Therefore, in the above-described discharge container, the pump head may be removed from the upper part of the stem, together with a bubble-foaming unit intentionally or accidentally. There is another problem in that when the pump head is removed from the upper part of the stem, the upper part of the gas-liquid mixing chamber inside the upper part of the stem is opened to result in a spherical liquid discharge valve accommodated inside the gas-liquid mixing chamber protruding outside, the loss of which will deprive the discharge container of the function as a pump.

The discharge container described in Patent Document 2 above has a problem in that a special valve-operating mechanism is disposed inside a pushdown head (nozzle head), the structure of which is complicated requiring a larger number of assembly steps.

The present invention has been made in view of solving the above problems, an object of which is to provide a discharge container in which a valve-operating mechanism is simplified to reduce the number of components used in a discharge pump, thus making it possible to reduce the production cost, to prevent the nozzle head of the discharge pump from being removed easily from the upper part of the stem of the discharge pump and also to prevent by using a simple structure a contained liquid from remaining inside the nozzle after discharge of the contained liquid.

A first aspect of the present invention is a discharge container, which is provided with a container main body, a discharge pump for discharging a contained liquid from a nozzle and a fixing cap, and the discharge pump is provided with a cylinder member made of a large-diameter cylinder and a small-diameter cylinder having an inlet pipe at the lower end, a piston member mounted on the cylinder member, and a nozzle head. The piston member is provided with a piston engaged with the small-diameter cylinder internally so as to slide freely, a poppet valve engaged with the piston, a piston guide engaged with the upper end of the piston, an air piston which forms an air chamber inside the large-diameter cylinder, an air piston valve engaged with the lower external circumference of the inner tube portion to open and close the air hole of the air piston, and a stem. The air piston is provided with an inner tube portion engaged with the outer circumference of the piston guide, an upper wall portion having an air hole, and a sliding tube portion engaged with the large-diameter cylinder internally so as to slide freely. The stem is provided with a lower tube portion which is engaged with the upper part of the piston guide to form a gas-liquid mixing chamber including a ball valve internally at the upper part of the piston guide and also engaged with the upper inner tube of the inner tube portion so as to slide freely, and a mesh ring mounted on the upper inner circumference. The nozzle head is mounted on the outer circumference of the stem.

In the discharge container of the present invention, a vent hole may be drilled in the circumference wall of the large-diameter cylinder. The vent hole is opened and closed by the vertical movement of the sliding tube portion, thereby preventing the container main body from being made negative in pressure by the suction of a contained liquid thereinside.

In the discharge container of the present invention, an engaging portion may be formed at the upper end of the inner circumference on the circumference wall of the large-diameter cylinder, and an inner lid having an upper plate and an engaging tube may be fitted into the engaging portion.

A second aspect of the present invention is a discharge container which is provided with a container main body, a discharge pump for discharging a contained liquid from a nozzle, and a fixing cap, and the discharge pump is provided with a cylinder member made of a large-diameter cylinder and a small-diameter cylinder having an inlet pipe at the lower end, a piston member mounted on the cylinder member and a nozzle head. The piston member is provided with a piston engaged with the small-diameter cylinder internally so as to slide freely, a poppet valve engaged with the piston, a piston guide engaged with the upper end of the piston, an air piston which forms an air chamber inside the large-diameter cylinder and a stem. The air piston is provided with an inner tube portion engaged with the outer circumference of the piston guide, an upper wall portion, an upper outer tube set upright at the upper wall portion, and a sliding tube portion engaged with a large-diameter cylinder internally so as to slide freely. The stem is provided with a lower tube portion, which is engaged with the upper part of the piston guide to form a gas-liquid mixing chamber including a ball valve internally at the upper part of the piston guide and also engaged with the upper part of the inner tube portion so as to slide freely, an upper tube portion at which a sealing tube is installed consecutively, and a mesh ring mounted on the upper inner circumference. The nozzle head is mounted on the outer circumference of the stem.

In the discharge container of the present invention, a flange may be installed on the outer circumference of the tube portion of the stem, a sealing tube may be installed vertically from the flange, an upper outer tube having an air passage channel at the upper end of the outer circumference may be set upright at the upper wall portion of the air piston, and an air hole may be drilled at an upper wall portion between the upper outer tube and the inner tube portion. The inner circumference face of the sealing tube is slidingly in contact with the outer circumference face of the upper outer tube in accordance with the vertical movement of the stem, thereby opening and closing an air passage channel between the air chamber and the outside of the container.

In the discharge container of the present invention, a vent hole may be drilled in the circumference wall of the large-diameter cylinder. The vent hole is opened and closed by the vertical movement of the sliding tube portion, thereby preventing the container main body from being made negative in pressure by the suction of a contained liquid thereinside.

According to the discharge container of the present invention, the nozzle head is pushed down, by which, as with a conventional discharge container, the contained liquid of the container main body is sucked up and mixed with air fed from an air chamber inside a gas-liquid mixing chamber to produce bubbles in the course of passing through a mesh ring, and the thus bubbled contained liquid is discharged from the nozzle hole of the nozzle head. Then, a vent hole is installed on the large-diameter cylinder portion. Since the vent hole is opened and closed by the vertical movement of the sliding tube portion, eliminated is a necessity for providing an air suction valve inside the container main body.

Further, since the piston guide is firmly fitted into the stem to form the gas-liquid mixing chamber, there is no chance that the gas-liquid mixing chamber is opened even if the nozzle head is removed from the stem.

A third aspect of the present invention is a discharge container which is provided with a container main body and a discharge pump for discharging a contained liquid from a nozzle, and the discharge pump is provided with a nozzle head, a stem, a tubular cylinder, a valve member, a piston and a first elastic member. On the nozzle head formed is a continuous hole which is opened on the lower end face of the nozzle head and communicatively connected to the nozzle. The stem is connected to the continuous hole and elongated downward to the nozzle head. The cylinder is arranged below the stem and inserted into the container main body. The valve member is installed at lower-end opening portion inside the cylinder so as to be separated from the lower-end opening portion. The piston is installed inside the cylinder so as to slide in a vertical direction. The first elastic member is installed between the piston and the valve member inside the cylinder, thus urging the piston upward. Between the nozzle head and the stem installed is a second elastic member which urges the nozzle head upward with respect to the stem. Then, the nozzle head is pushed down, by which the piston is pushed down via the stem to discharge the content inside the container main body from the nozzle.

According to the discharge container of the present invention, a second elastic member is installed between the nozzle head and the stem. Therefore, when the nozzle head is pushed down to discharge the content from the nozzle, not only the first elastic member but also the second elastic member are compressively deformed to push down the nozzle head with respect to the stem. When the nozzle head is released from being pushed down and the second elastic member is returned to its original configuration, the nozzle head is pushed upward with respect to the stem. Therefore, it is possible to make larger a volume obtained when the nozzle head is released from being pushed down in an inner space continued to the nozzle inside the nozzle head than that obtained before the nozzle head is released from being pushed down. Thereby, when the nozzle head is released from being pushed down, the inner space is made negative in pressure. As a result, the contained liquid which is not discharged when the nozzle head is pushed down but remains inside the nozzle is sucked from the nozzle into the inner space by making the inner space negative in pressure approximately at the same time when the nozzle head is released from being pushed down.

In the discharge container of the present invention, the nozzle may be made gradually smaller in passage-channel cross section along the continuous hole from the leading-end opening portion thereof. According to the discharge container of the present invention, an inner space continuing to the nozzle is made negative in pressure, thereby making it possible to suck more effectively the remaining content to be sucked from the nozzle to the inner space.

In the discharge container of the present invention, it is acceptable that the second elastic member be smaller in urging force than the first elastic member. According to the discharge container of the present invention, when the nozzle head is pushed down to discharge the contained liquid from the nozzle, at first, the second elastic member is compressively deformed and, thereafter, the first elastic member is compressively deformed to discharge the contained liquid from the nozzle. More specifically, in order to discharge the contained liquid, the second elastic member must be compressively deformed, thus making it possible to suck the contained liquid without fail when the nozzle head is released from being pushed down.

In contrast, in a case where, when the nozzle head is pushed down, at first, the first elastic member is compressively deformed to discharge the contained liquid from the nozzle and, thereafter, when the nozzle head is further pushed down, the second elastic member is compressively deformed, there is a possibility that a user may stop pushing down the nozzle head when the first elastic member is compressively deformed to discharge the contained liquid from the nozzle and may not push down the nozzle until the second elastic member is compressively deformed. In this instance, since the inner space does not change in volume in a step before or after the nozzle head is pushed down, there is no chance that the above-described effect is provided.

In the discharge container of the present invention, the cylinder is a cylinder for contained liquid and the piston is a piston for contained liquid. The discharge pump may be provided with a cylinder for air at which the piston for air is installed therein so as to slide freely, a gas-liquid mixing chamber at which a contained liquid sent from the cylinder for contained liquid is merged with air fed from the cylinder for air, a contained liquid discharge valve installed on a valve seat placed on the liquid entrance of the gas-liquid mixing chamber so as to be separated from the valve seat, and a bubble foaming member installed between the nozzle and the gas-liquid mixing chamber. The nozzle head is pushed down, by which the contained liquid of the container main body is merged with air inside the gas-liquid mixing chamber, the contained liquid merged with air is bubbled in the course of passing through the bubble foaming member, and the thus bubbled contained liquid is discharged from the nozzle.

According to the discharge container of the present invention, there is eliminated a necessity for installing an air suction valve inside the container main body, thus making it possible to reduce the number of components and decrease the production cost. Further, even if the nozzle head is removed from the upper part of the stem, there is no chance that a gas-liquid mixing chamber is opened, thus making it possible to prevent the ball valve from moving out from the gas-liquid mixing chamber.

According to the discharge container of the present invention, it is possible to prevent a contained liquid from remaining inside a nozzle after discharge of the contained liquid. As a result, it is possible to prevent the contained liquid from dripping from the nozzle. It is also possible to prevent the contained liquid remaining inside the nozzle from being denatured or solidified.

DETAILED DESCRIPTION OF EMBODIMENTS

An explanation will be made of Embodiment 1 of the discharge container of the present invention with reference to FIG. 1 through FIG. 6.

Figure 1:
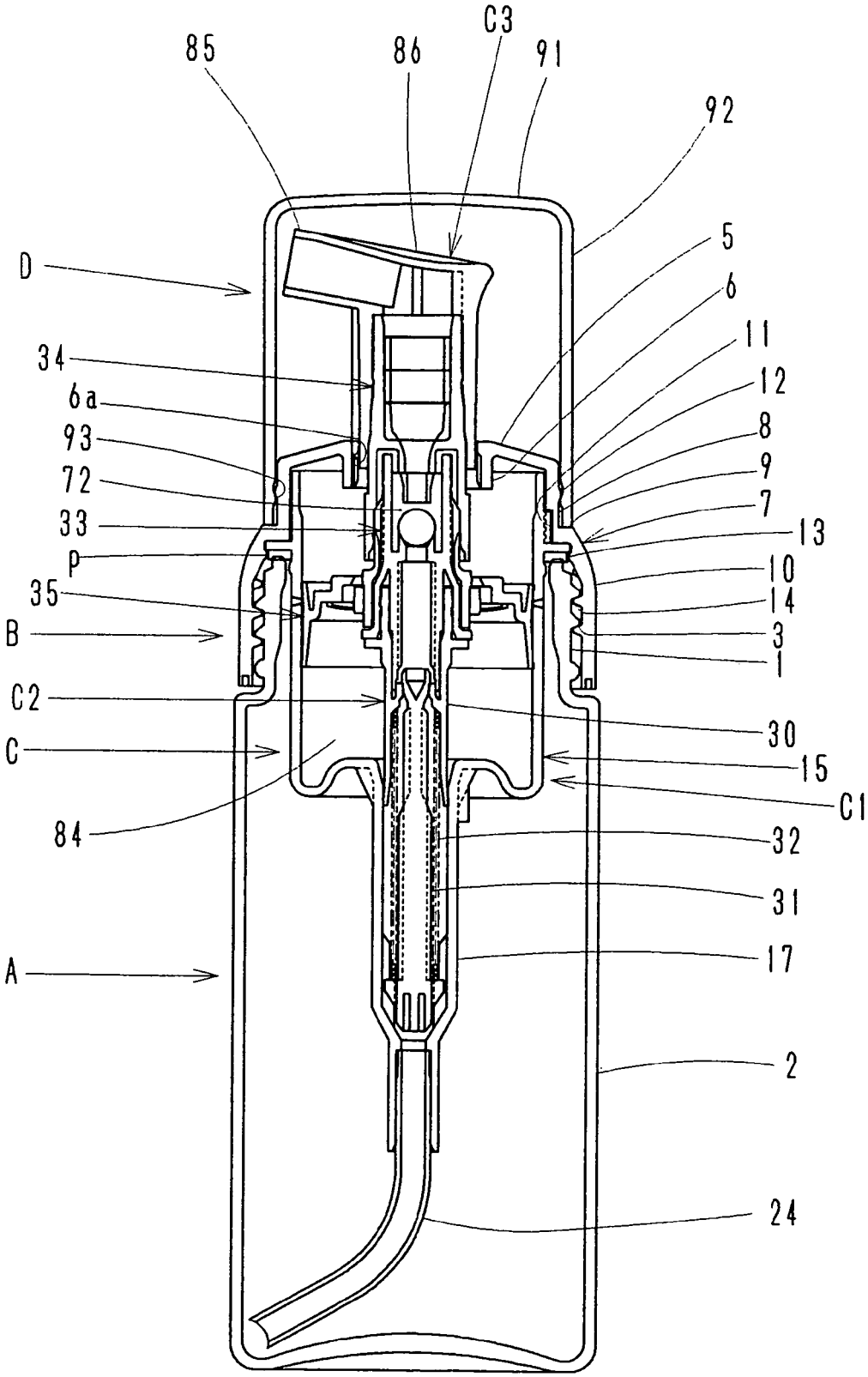
FIG. 1 is a cross-sectional view for illustrating Embodiment 1 of the discharge container of the present invention.

As illustrated in FIG. 1, the discharge container of the present embodiment is provided with a container main body A, a fixing cap B, a discharge pump C mounted at a tubular mouth portion 1 of the container main body A via a packing P by using the fixing cap B, and an over cap D capped on the upper part of the fixing cap B so as to be mounted in a removable manner.

The container main body A is provided with the tubular mouth portion 1, a body portion 2, and a bottom portion. A male thread 3 for fixing the fixing cap B is installed on the outer circumference of the tubular mouth portion 1.

The fixing cap B is provided with an upper wall 5; a guide tube 6 installed vertically on the inner brim of the upper wall 5 and a side circumference wall 7 installed vertically on the outer brim of the upper wall 5. A vertical groove **6*a* is installed on the inner circumference of the guide tube 6. The side circumference wall 7 is provided with an upper-side circumferential tube 8, a step portion 9 and a lower-side circumferential tube 10. An engaging recess 11 is installed on the inner circumference of the upper-side circumferential tube 8, and an engaging projected streak 12 engaged with the over cap D is installed on the outer circumference of the upper-side circumferential tube 8. An engaging portion 13, which is engaged with the discharge pump C to hold it, is installed at the upper part of the inner circumference of the lower-side circumferential tube 10, and a female thread 14, which is engaged with the male thread 3 of the tubular mouth portion 1 of the container main body A, is installed at the lower part of the lower side circumferential tube 10**.

Figure 2:
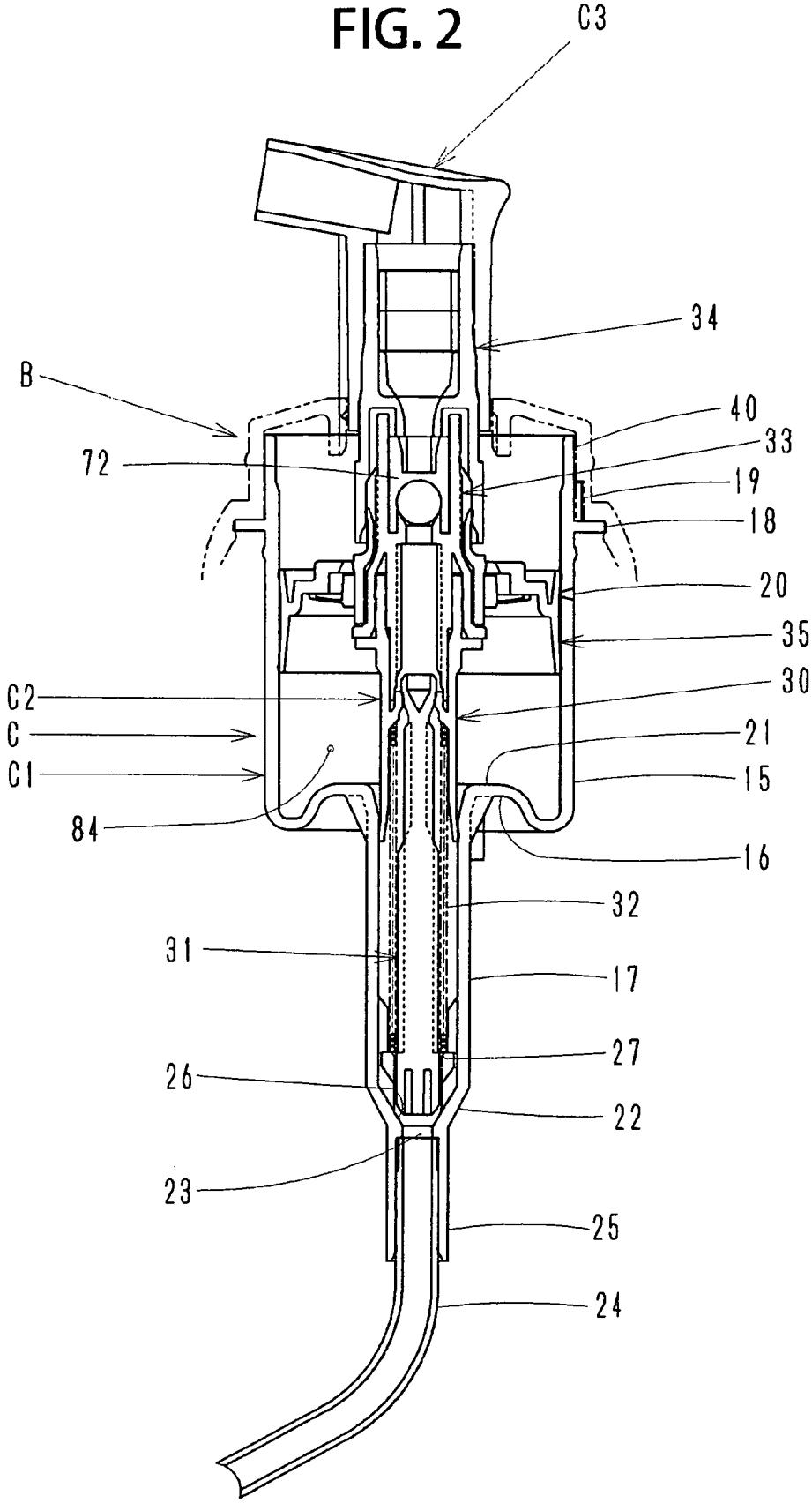
FIG. 2 is a cross-sectional view for illustrating a discharge pump included in the discharge container of Embodiment 1.

As illustrated in FIG. 1 and FIG. 2, the discharge pump C is provided with a cylinder member C1, a piston member C2 and a nozzle head C3 mounted on the piston member C2.

Figure 3:
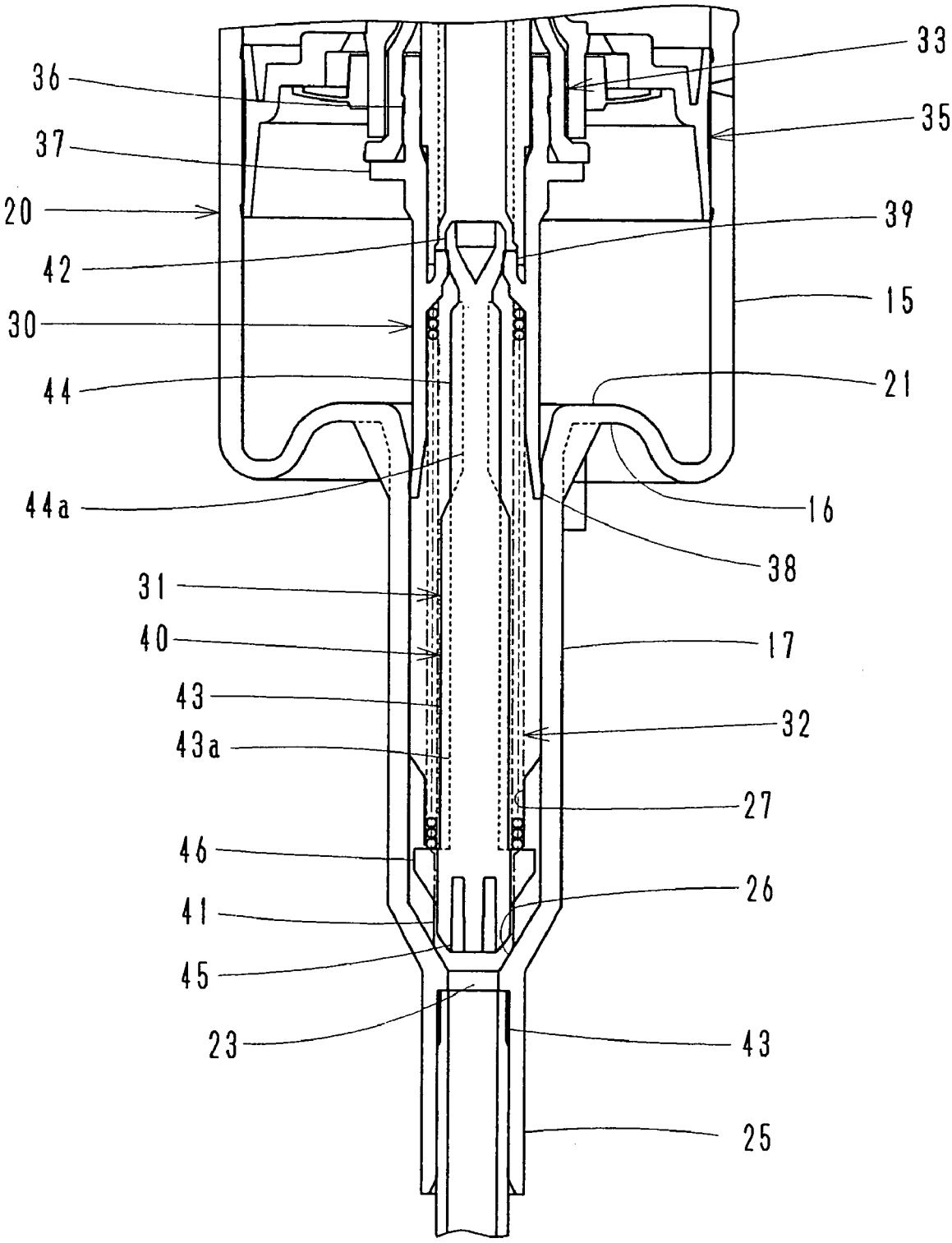
FIG. 3 is a cross-sectional view for illustrating a small-diameter cylinder portion, a piston, a poppet valve and the like included in the discharge container of Embodiment 1.

As illustrated in FIG. 2 and FIG. 3, the cylinder member C1 is provided with a large-diameter cylinder 15, a bottom wall 16 and a small-diameter cylinder 17. A fixing flange 18, which is engaged with the engaging portion 13 of the fixing cap B, is installed at the upper part of the large-diameter cylinder 15. A positioning projection 19, which is projected from the large-diameter cylinder 15 and engaged with the engaging recess 11, is installed on the upper face of the fixing flange 18. A vent hole 20 is formed in the large-diameter cylinder 15.

A raised portion 21 is formed at the center of the bottom wall 16, and the small-diameter cylinder 17 is installed vertically downward from the center thereof. A conical tube 22, which is formed so as to reduce in diameter, is installed on the lower end portion of the small-diameter cylinder 17, and a passage port 23 is formed at the lower end of the conical tube 22.

A connecting tube 25 for fixing an inlet pipe 24 is installed vertically downward at the lower end of the conical tube 22.

The inner lower part of the conical tube 22 is provided with a valve seat 26, and a plurality of spring receiving ribs 27 are protruded on the inner face of the conical tube 22 so as to enclose the valve seat 26.

As illustrated in FIG. 2 through FIG. 5, the piston member C2 is provided with a piston 30, a poppet valve 31, a spring 32, a piston guide 33, a stem 34, and an air piston 35. The piston 30 is mounted on the inner circumference of the small-diameter cylinder 17 so as to slide freely. The poppet valve 31 is disposed on the inner side of the piston 30. The piston guide 33 is installed consecutively at the upper end of the piston 30. The stem 34 is mounted at the upper end of the piston guide 33. The air piston 35 is mounted on the inside of the large-diameter cylinder 15 so as to slide freely.

As illustrated in FIG. 3, the piston 30 is provided with a tube portion 36 and an engaging flange 37 installed on the upper outer circumference of the tube portion 36. The lower part of the tube portion 36 is expanded in diameter downwardly, and a sealing tube portion 38, which slides on the inner circumference face of the small-diameter cylinder 17, is formed at this part. An engaging ring 39, which is internally protruded and bent, is protruded at the midpoint of the inner circumference face of the tube portion 36, and a spring 32 is elastically installed between the lower face of the engaging ring 39 and the spring receiving rib 27 of the small-diameter cylinder 17.

The poppet valve 31 is provided with a shaft body 40, a lower valve member 41 installed at the lower part of the shaft body 40 and an upper valve member 42 installed at the upper part of the shaft body 40. The shaft body 40 is made up of a large-diameter portion 43 and a small-diameter portion 44 formed above the large-diameter portion 43. A plurality of vertical grooves 43*a* extending in a vertical direction are formed on the outer circumference face of the large-diameter portion 43, and a plurality of vertical grooves 44*a* extending in a vertical direction are formed on the outer circumference face of the small-diameter portion 44.

The upper valve member 42 is expanded in diameter upwardly. The inner circumference face of the engaging ring 39 of the piston 30 is engaged with the outer circumference face of the upper valve member 42. A valve portion 45, which is engaged with the valve seat 26 of the small-diameter cylinder 17 to open and close the passage port 23, is formed at the lower end of the lower valve member 41. An engaging rib 46, which is inserted between a plurality of spring receiving ribs 27 provided on the small-diameter cylinder 17 so as to move vertically, is provided at the upper part of the lower valve member 41.

Figure 4:
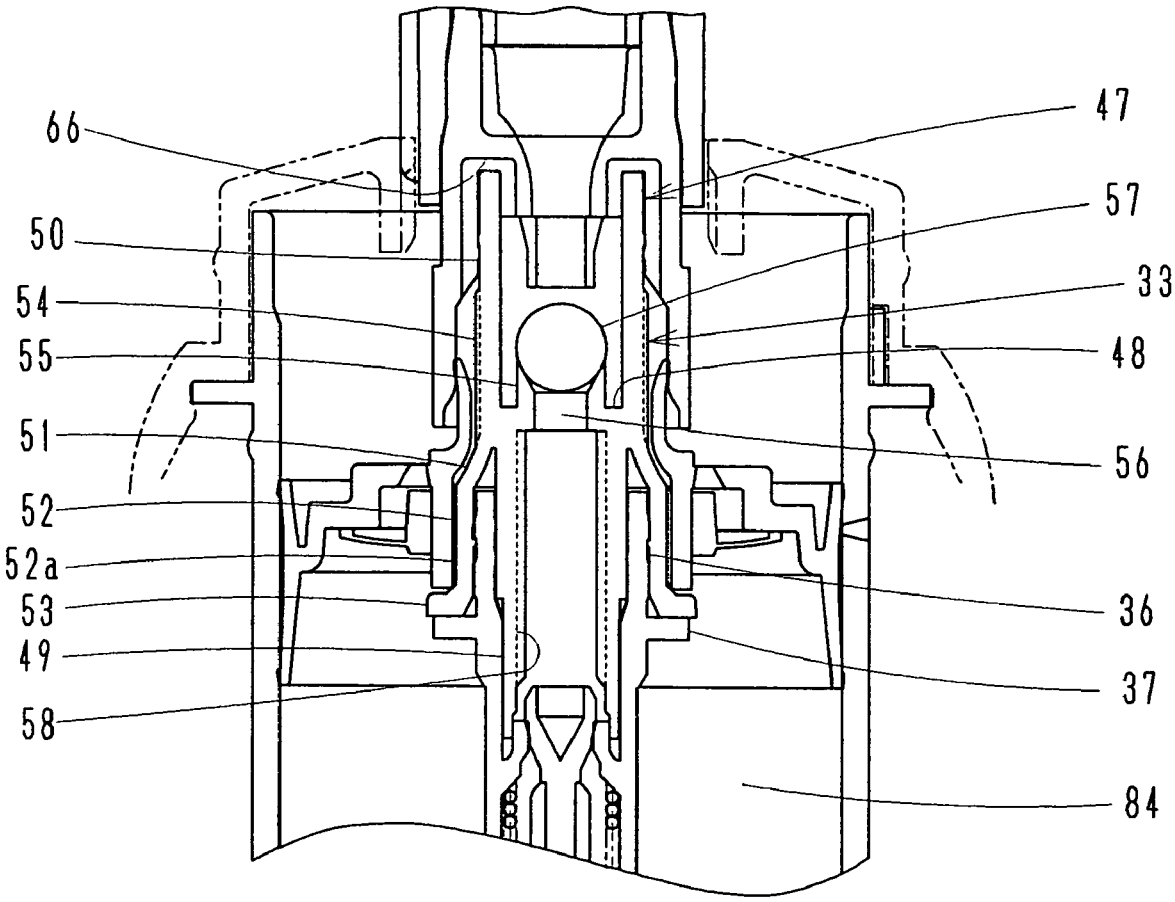
FIG. 4 is a cross-sectional view for illustrating a piston guide, an air piston, a stem and the like included in the discharge container of Embodiment 1.

As illustrated in FIG. 2 and FIG. 4, the piston guide 33 is provided with an outer tube portion 47, a partition plate 48 disposed on the inner circumference of the outer tube portion 47 and an inner tube portion 49 installed vertically from the lower face of the partition plate 48.

The outer tube portion 47 is provided with an upper tube portion 50, a diameter-expanding tube portion 51, a lower tube portion 52 and an engaging flange 53 in a descending order. The diameter-expanding tube portion 51 is expanded in diameter downwardly. The inner circumference of the lower tube portion 52 is engaged with the upper outer circumference of the tube portion 36 of the piston 30. The engaging flange 53 is installed at the lower end of the diameter-expanding tube portion 51 and engaged with the upper face of the engaging flange 37 of the piston 30. A plurality of vertical ribs 54 are set upright below the outer circumference of the upper tube portion 50, and a plurality of vertical grooves 52*a* extending in a vertical direction are disposed on the outer circumference face of the lower tube portion 52.

The partition plate 48 is formed so as to protrude internally from the inner circumference of the lower end at the upper tube portion 50 of the outer tube portion 47 and also give an annular shape. A valve seat tube 55 is set upright at the inner circumference brim of the partition plate 48, and a passage port 56 is formed thereinside. A ball valve 57 is disposed at the upper end of the valve seat tube 55.

The outer circumference of the inner tube portion 49 is engaged with the inner circumference of the lower tube portion 52 at the outer tube portion 47 and also engaged with the upper part of the inner circumference of the tube portion 36 of the piston 30, thereby the piston guide 33 is fitted and attached to the upper part of the piston 30. A plurality of vertical ribs 58 are protruded on the inner circumference of the inner tube portion 49. The side circumference of the upper valve member 42 of the poppet valve 31 is engaged with the vertical rib 58 internally. The lower end of the inner tube portion 49 is made thin and engaged with the engaging ring 39 of the piston 30.

Figure 5:
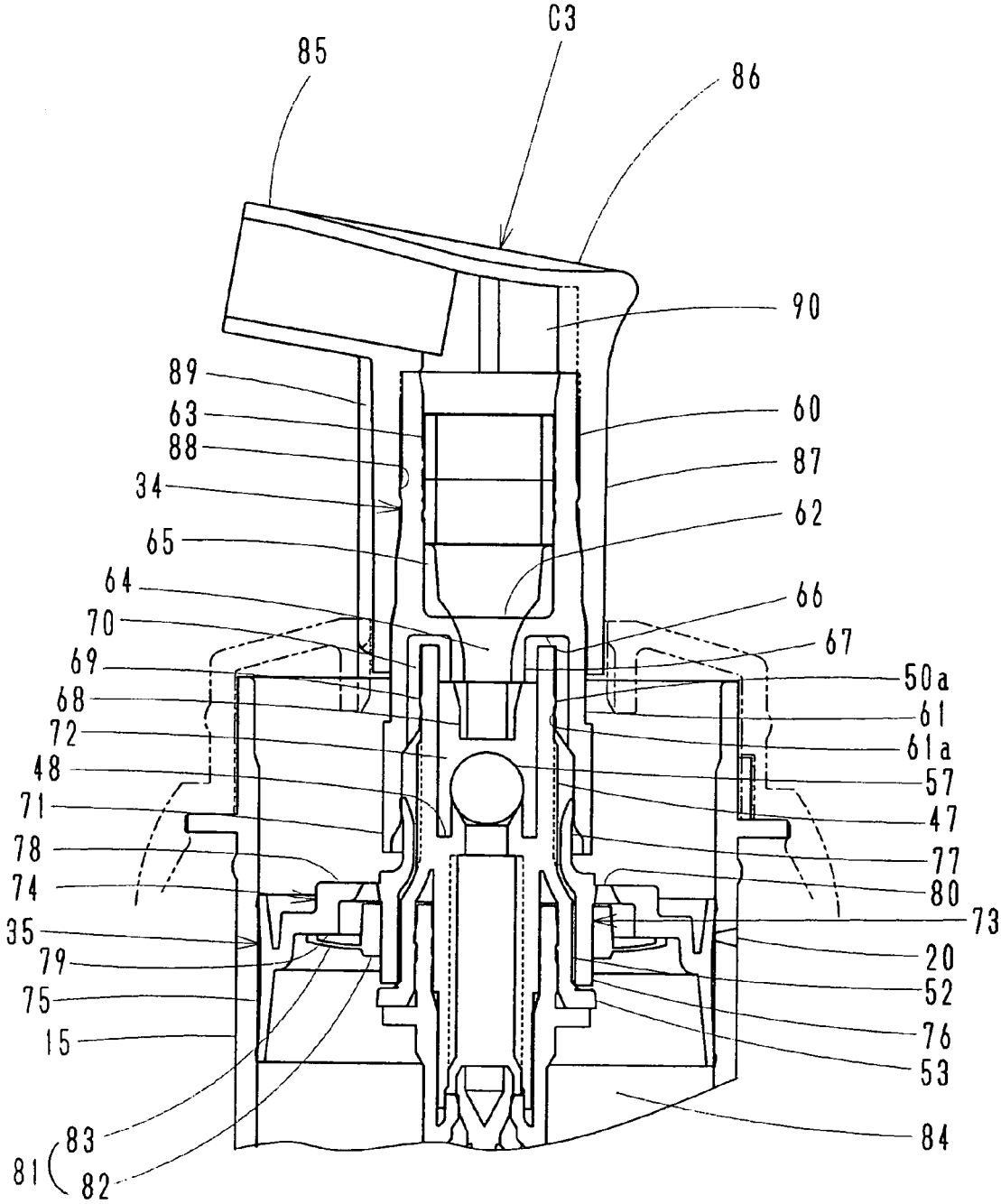
FIG. 5 is a cross-sectional view for illustrating a stem, a nozzle head and the like included in the discharge container of Embodiment 1.
Figure 6:
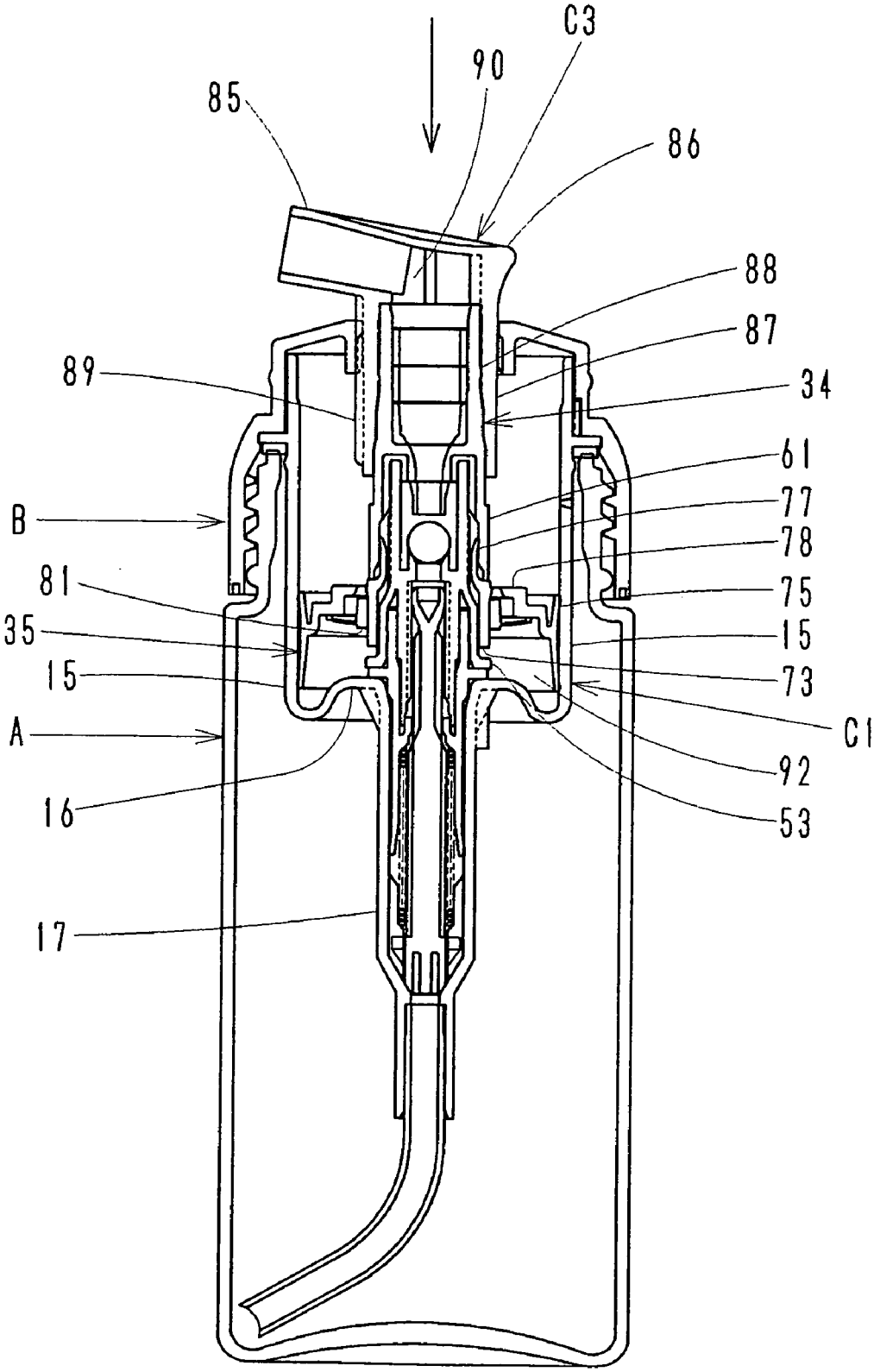
FIG. 6 is a cross-sectional view for illustrating a state that the nozzle head is pushed down in the discharge container of Embodiment 1.

As illustrated in FIG. 2 and FIG. 5, the stem 34 is provided with an upper tube portion 60 and a lower tube portion 61. A mesh ring 63 is mounted on the inner circumference of the upper tube portion 60, and a partition 62 is installed on the inner circumference of the lower end portion at the upper tube portion 60. A passage hole 64 is drilled in the partition 62. A retention portion 65 of the mesh ring 63 is installed on the upper face of the partition 62. The retention portion 65 is extended upwardly from the circumference brim of the passage hole 64.

The partition 62 is provided with an annular upper wall portion 66 and an inner tube 67 installed vertically on the inner brim of the upper wall portion 66. A valve portion 68, which is reduced in diameter downwardly, is installed at the lower end of the inner tube 67. The ball valve 57 is restricted in movement range by the lower end of the valve portion 68 and the upper end of the valve seat tube 55 on the inner circumference of the piston guide 33.

The inner circumference face below the lower tube portion 61 of the stem 34, the lower face of the upper wall portion 66 of the partition 62 and the outer circumference face of the inner tube 67 constitute an engaging portion 69, which is engaged with the upper part of the upper tube portion 50 of the piston guide 33. Swelling portions 61*a*, 50*a* are installed respectively on the inner circumference face of the lower tube portion 61 and the outer circumference face of the upper tube portion 50 and fitted and attached thereto so that the stem 34 does not easily come off from the piston guide 33. At the stem 34 are formed a plurality of air grooves 70, which lead from the inner circumference face of the lower tube portion 61 to the outer circumference face of the inner tube 67.

The lower end of the lower tube portion 61 is expanded in diameter to form an engaging tube 71. The inner circumference of the engaging tube 71 forms a passage channel leading to the air groove 70. Further, a gas-liquid mixing chamber 72 is demarcated by the inner circumference face of the upper tube portion 50 of the piston guide 33, the partition plate 48 and the upper wall portion 66 of the stem 34.

As illustrated in FIG. 5, the air piston 35 is provided with an inner tube portion 73, an annular upper wall portion 74 and a sliding tube portion 75. The sliding tube portion 75 is installed consecutively on the outer brim of the upper wall portion 74 and inserted into the inner circumference of the large-diameter cylinder 15 of the cylinder member C1, thereby sliding thereon while keeping a liquid-tight state. Further, the sliding tube portion 75 seals the vent hole 20 made on the large-diameter cylinder 15, when the piston is elevated. The inner tube portion 73 is provided with a lower inner tube 76 installed consecutively on the inner brim of the upper wall portion 74 and an upper inner tube 77 set upright so as to bend internally from the inner brim on the upper face of the lower inner tube 76.

The lower inner tube 76 is at the lower end in contact with the upper face of the engaging flange 53 of the piston guide 33, with the inner circumference sliding on the outer circumference face of the lower tube portion 52 at the outer tube portion 47. The upper inner tube 77 is formed in such a manner that the inner circumference slides, with a clearance kept between the diameter-expanding tube portion 51 of the outer tube portion 47 of the piston guide 33 and the lower external circumference of the upper tube portion 50.

The upper wall portion 74 is provided with an upper-part wall 78 at which an inner brim is installed consecutively on the outer circumference of the inner tube portion 73 and a lower-part wall 79 at which the inner brim is installed consecutively on a tubular wall installed vertically on the lower face of the outer brim of the upper-part wall 78. A plurality of air holes 80 are drilled in the upper-part wall 78.

An air piston valve 81 is mounted on the lower part of the air piston 35. The air piston valve 81 is constituted with a tube portion 82 and a circular disk-shaped valve portion 83. The inner circumference of the tube portion 82 is engaged with the outer circumference of the lower inner tube 76. The valve portion 83 is extended upwardly from the lower part of the outer circumference of the tube portion 82, and the upper leading end of the valve portion 83 is in contact with the lower face of the lower-part wall 79 of the air piston 35. An air chamber 84 is formed inside the large-diameter cylinder 15 further below from the upper wall portion 74 of the air piston 35.

The nozzle head C3 is provided with a head portion 86 having a nozzle 85 on one side and a tube portion 87 installed vertically below the head portion 86. An engaging portion 88, which is engaged with the outer circumference of the upper tube portion 60 of the stem 34, is installed on the inner circumference of the tube portion 87. A vertical rib 89 is installed on the outer circumference of the tube portion 87. The vertical rib 89 is engaged with a vertical groove 6*a* installed on the inner circumference of the guide tube 6 on the fixing cap B, thereby preventing the nozzle head C3 from being rotated on the inner circumference of the guide tube 6. A passage channel 90 running through the inside of the head portion 86 from the inside of the tube portion 87 and continuing to the leading end of the nozzle 85 is formed inside the nozzle head C3.

As illustrated in FIG. 1, the over cap D is constituted with a top wall 91 and a side circumference wall 92. An engaging projected streak 93, which is engaged with the engaging projected streak 12 of the fixing cap B, is installed at the lower end portion of the side circumference wall 92.

Next, an explanation will be made of the actions and effects of the discharge container of the present embodiment.

In using the discharge container, at first, the over cap D is removed from the upper part of the fixing cap B. Then, the nozzle head C3 is pushed down, by which, as with a conventional known container, the stem 34, the piston guide 33 and a piston 30 are pushed down, a contained liquid inside the small-diameter cylinder 17 is sucked up and mixed with air inside a gas-liquid mixing chamber 72, then, the resultant contained liquid is changed into a bubble form in the course of passing through the mesh ring 63, and the bubble-form contained liquid is discharged from the nozzle 85. The discharge container at which the nozzle head C3 is pushed down is finally made into a state given in FIG. 6.

When the nozzle head C3 is initially pushed down, the stem 34 and the piston guide 33 are moved downwardly. However, the air piston 35 receives resistance due to the fact that the inner circumference face of the large-diameter cylinder 15 is in contact with the sliding tube portion 75 of the air piston 35 and does not move together with the stem 34 and the piston guide 35.

When the nozzle head C3 is further pushed down, the swelling portion 61*a* of the lower tube portion 61 of the stem 34 is in contact with the upper face of the lower inner tube 76 of the air piston 35 to push down the air piston 35, thereby elevating the air pressure inside the air chamber 84.

Air inside the air chamber 84 passes through a space between the lower end of the lower inner tube 76 of the air piston 35 and the upper face of the engaging flange 53 of the piston guide 33 through the vertical groove 52*a* of the lower tube portion 52 of the piston guide 33 and also through a space between the vertical ribs 54 at the upper tube portion 50. Subsequently, the air passes through a space between the outer circumference of the piston guide 33 and the lower end portion at the lower tube portion 61 of the stem 34 through the air groove 70 of the stem 34 and flows into the gas-liquid mixing chamber 72. Then, a contained liquid sucked up from the passage port 56 into the gas-liquid mixing chamber 72 is mixed with the air, and the mixture is fed through an opening of the valve portion 68 of the stem 34 into the mesh ring 63. The contained liquid mixed with the air is bubbled in the course of passing through the mesh ring 63 and discharged from the nozzle 85.

The air piston 35 is pushed down to release the sealing-off of the vent hole 20 on the large-diameter cylinder 15 by the sliding tube portion 75 of the air piston 35, by which air infiltrated from outside a container is supplied through the vent hole 20 into a container main body A. Therefore, a contained liquid is sucked up, thus making it possible to prevent the container main body A from being made negative in pressure thereinside.

When the contained liquid is completely discharged and the nozzle head C3 is released from being pushed down, as with a conventional known container, the nozzle head C3, the stem 34, the piston guide 33 and the piston 30 are elevated due to a restoring force of the spring 32. The contained liquid inside the container main body A is sucked up into the small-diameter cylinder via the inlet pipe 24 and finally returned to a state given in FIG. 1.

Even when the stem 34 and the piston guide 33 begin to ascend, the air piston 35 will not ascend immediately due to the fact that the inner circumference face of the large-diameter cylinder 15 is in contact with the sliding tube portion 75 of the air piston 35. Then, the inner circumference face of the engaging tube 71 of the stem 34 slides on the outer circumference face of the upper inner tube 77 of the air piston 35, and the lower end of the lower inner tube 76 of the air piston 35 is engaged with the upper face of the engaging flange 53 of the piston guide 33 to block a flow channel between the air chamber 84 and the gas-liquid mixing chamber 72, by which the contained liquid and air can be prevented from flowing back into the air chamber 84 from the gas-liquid mixing chamber 72.

When the piston guide 33 ascends further, the upper face of the engaging flange 53 of the piston guide 33 pushes up the lower end of the lower inner tube 76 of the air piston 35, by which the air piston 35 also starts to ascend.

When the air piston 35 ascends, the pressure is made negative inside the air chamber 84. Then, the valve portion 83 of the air piston valve 81 mounted at the lower part of the air piston 35 is deformed, by which the lower-part wall 79 of the air piston 35 is disengaged therefrom to release the valve portion 83, and air is supplied into the air chamber 84. Further, when the air piston 35 ascends, the vent hole 20 of the large-diameter cylinder 15 is blocked by the sliding tube portion 75 of the air piston 35.

The nozzle head C3 is repeatedly pushed down, thereby making it possible to discharge a bubble-form contained liquid at a desired quantity from the nozzle 85. Where no discharge container is used, the over cap D is capped from the upper part of the fixing cap B, thus making it possible to prevent dust and water from entering into the container.

In the discharge container of the present embodiment, even if the nozzle head C3 of the discharge pump C is removed from the upper part of the discharge pump C intentionally or accidentally upon impact resulting from fall of a container, the stem 34 is firmly fitted into the upper part of the piston guide 33, thereby the stem 34 serves as a lid body of the gas-liquid mixing chamber 72. Therefore, it is possible to prevent the ball valve 57 from moving out of the gas-liquid mixing chamber 72.

Next, an explanation will be made of Embodiment 2 of the discharge container of the present invention with reference to FIG. 7 to FIG. 10. It is to be noted that the same constituents as those of Embodiment 1 are given the same symbols or numerals, a detailed explanation of which will be omitted here.

Figure 7:
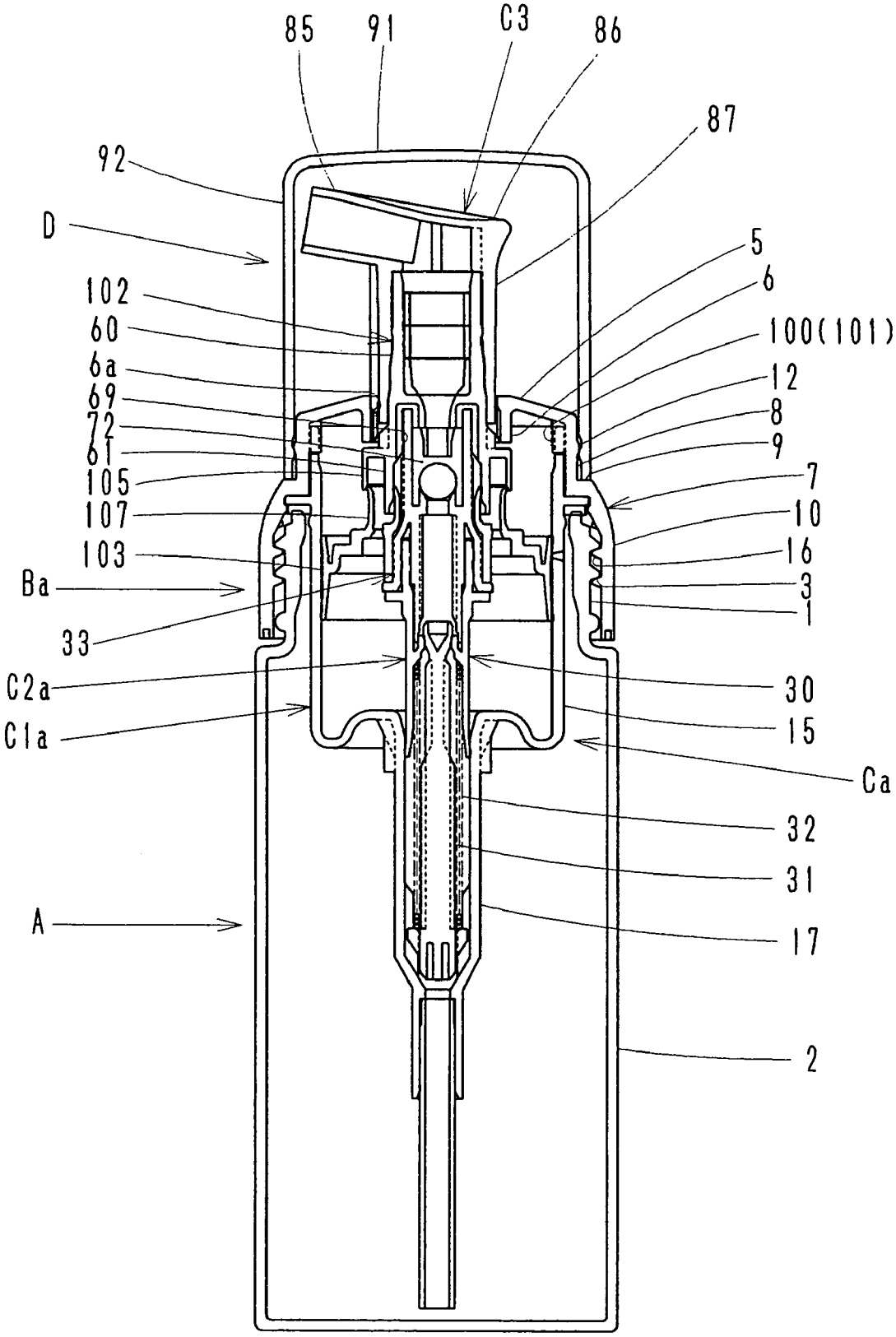
FIG. 7 is a cross-sectional view for illustrating Embodiment 2 of the discharge container of the present invention.

As illustrated in FIG. 7, the discharge container of the present embodiment is provided with a container main body A, a fixing cap Ba, a discharge pump Ca mounted at the mouth portion of the container main body A via a packing P by the fixing cap Ba, and an over cap D capped on the upper part of the fixing cap Ba in a removable manner.

The fixing cap Ba is provided with an upper wall 5, a guide tube 6 installed vertically on the inner brim of the upper wall 5, and a side circumference wall 7 installed vertically on the outer brim of the upper wall. An engaging projection 100 is installed at the upper part of the inner circumference of the upper-side circumferential tube 8 of the side circumference wall 7, and an engaging projected streak 12, which is engaged with the over cap D, is installed on the outer circumference of the upper-side circumferential tube 8.

Figure 8:
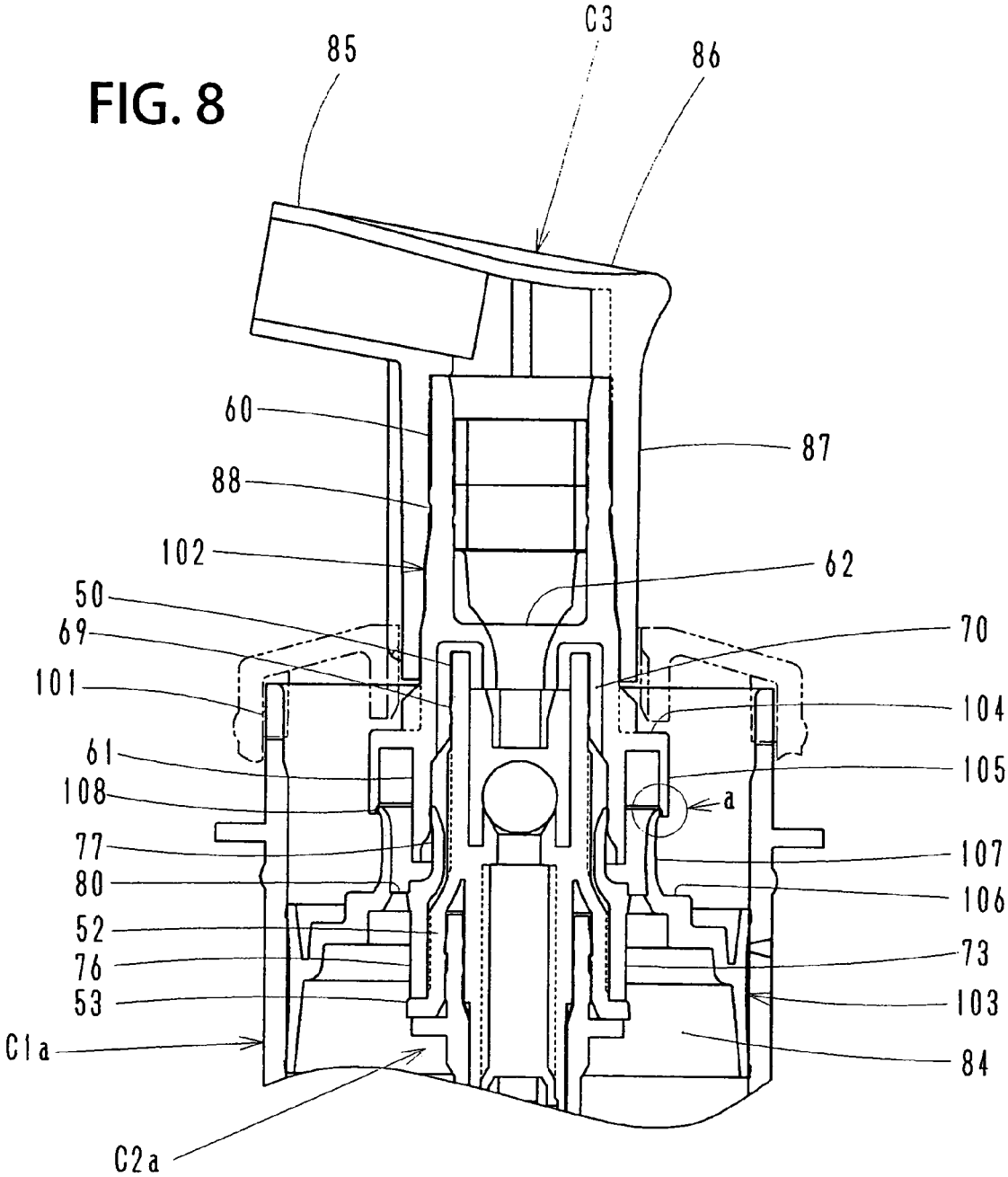
FIG. 8 is a cross-sectional view for illustrating a discharge pump included in the discharge container of Embodiment 2.
Figure 9:
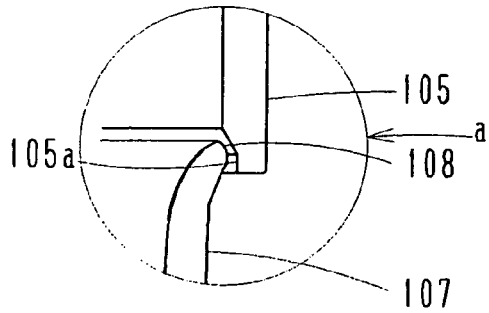
FIG. 9 is an enlarged view for illustrating "a" part given in FIG. 8.

As illustrated in FIG. 7 through FIG. 9, the discharge pump Ca is provided with a cylinder member C1*a*, a piston member C2*a* and a nozzle head C3 mounted on the piston member C2*a*. The cylinder member C1*a* is provided with a large-diameter cylinder 15, a bottom wall 16 and a small-diameter cylinder 17. A positioning recess 101, which is engaged with an engaging projection 100 of the fixing cap Ba, is installed at the upper end portion of the large-diameter cylinder 15.

The piston member C2*a* is provided with a piston 30, a poppet valve 31, a spring 32, a piston guide 33, a stem 102 mounted at the upper end of the piston guide 33 and an air piston 103 mounted on the inner circumference of the large-diameter cylinder 15 so as to slide freely.

As with Embodiment 1, the stem 102 is fitted and attached thereto so as not to easily come off from the piston guide 33 by the engaging portion 69 which is engaged with the upper part of the upper tube portion 50 of the piston guide 33. The stem 102 is provided with an upper tube portion 60 and a lower tube portion 61, and a partition 62 is installed on the inner circumference of the lower end portion of the upper tube portion 60. A flange 104 is installed on the outer circumference of the lower tube portion 61. A sealing tube 105 is installed vertically from the outer brim of the flange 104. A diameter-expanding portion 105*a* is installed at the lower end of the sealing tube 105.

As with Embodiment 1, the air piston 103 is provided with an inner tube portion 73, an annular upper wall portion 74, and a sliding tube portion 75. The sliding tube portion 75 is installed consecutively on the outer brim of the upper wall portion 74 and inserted into the inner circumference of the large-diameter cylinder 15 of the cylinder member C1*a*, thus sliding thereon while keeping a liquid-tight state.

The upper wall portion 74 is provided with an upper wall portion 106, and the inner brim of the upper wall portion 106 is installed consecutively on the outer circumference of the inner tube portion 73. An upper outer tube 107 is set upright on the upper face of the upper wall portion 106. The upper end outer circumference of the upper outer tube 107 is slightly expanded to serve as a sealed portion 108. A plurality of air holes 80 are drilled between the upper outer tube 107 and the inner tube portion 73.

The upper outer tube 107 and the sealed portion 108 are engaged with the inner circumference of the sealing tube 105 of the stem 102 so as to slide freely. When the stem 102 ascends, air flows into a clearance between the diameter-expanding portion 105*a* at the lower end of the sealing tube 105 and the sealed portion 108.

Next, an explanation will be made of actions and effects of the discharge container of the present embodiment.

When the nozzle head C3 ascends, air flowing into a clearance between the inner circumference of the guide tube 6 of the fixing cap Ba and the outer circumference of the tube portion 87 of the nozzle head C3 passes through a space between the diameter-expanding portion 105*a* at the lower end of the sealing tube 105 of the stem 102 and the sealed portion 108 of the upper outer tube 107 of the air piston 103, flowing into the air chamber 84 via the air hole 80.

In this instance, the lower end of the lower inner tube 76 of the air piston 103 is engaged with the upper face of the engaging flange 53 of the piston guide 33, and also the upper end of the upper inner tube 77 of the air piston 103 is engaged with the lower inner circumference of the lower tube portion 61 of the stem 102, by which air inside the air chamber 84 is prevented from flowing into the gas-liquid mixing chamber 72.

When the nozzle head C3 is initially pushed down to discharge a contained liquid from a nozzle, the stem 102 and the piston guide 33 move downward. However, the air piston 103 undergoes resistance due to the fact that the inner circumference face of the large-diameter cylinder 15 of the cylinder member C1*a* is in contact with the sliding tube portion 75 of the air piston 103 and will not move downward.

Thereby, the inner circumference face of the sealing tube 105 of the stem 102 is engaged with the sealed portion 108 of the upper outer tube 107 of the air piston 103. Then, air is stopped from flowing therein, and the lower end of the lower inner tube 76 of the air piston 103 is disengaged from the upper face of the engaging flange 53 of the piston guide 33 to form a clearance between the lower end of the lower inner tube 76 and the upper face of the engaging flange 53. In this instance, since the sealed portion 108 is expanded upwardly, the sealed portion 108 is pressed by the inner circumference wall of the sealing tube 105, thus making it possible to seal a space between the sealing tube 105 and the sealed portion 108 more assuredly.

Figure 10:
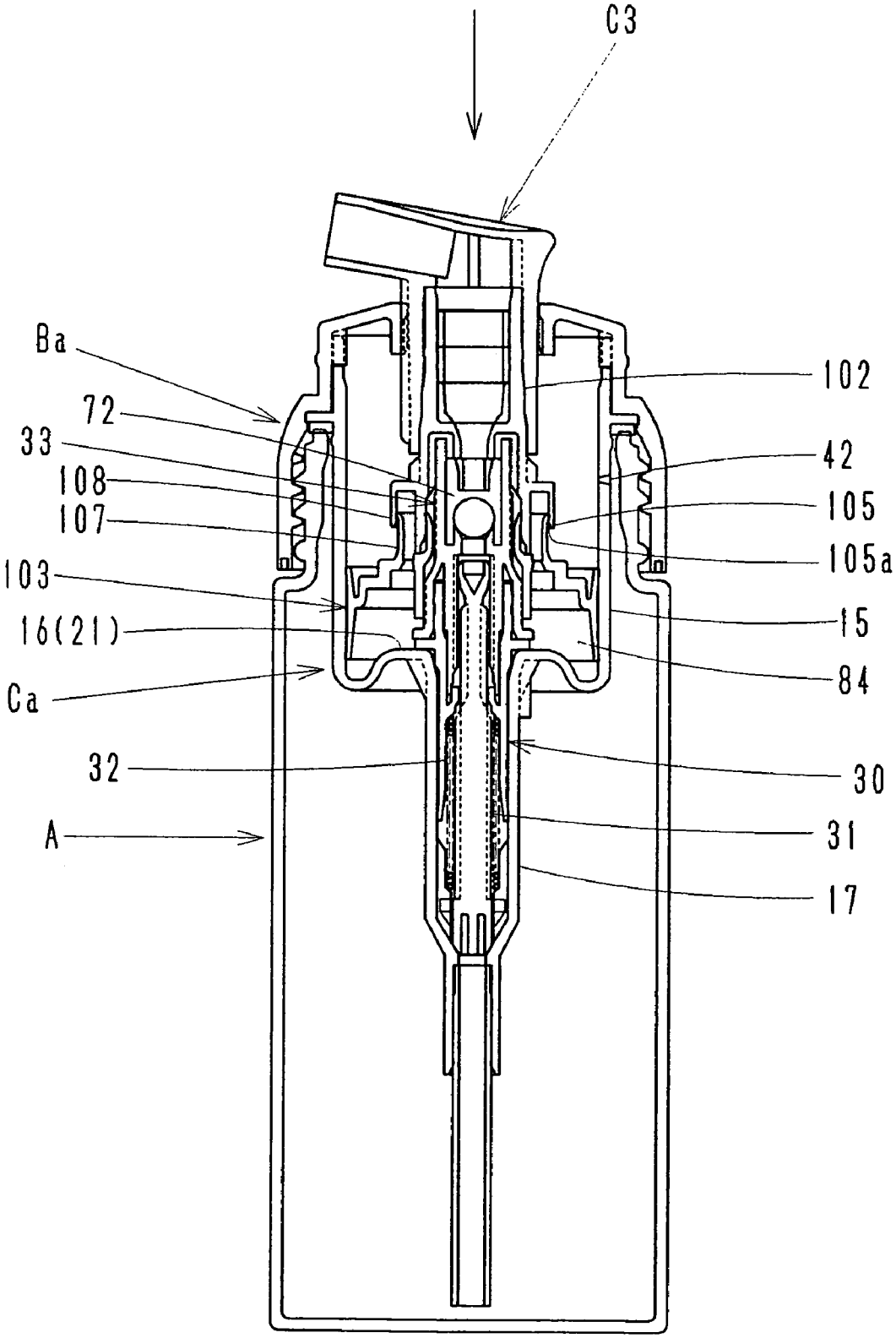
FIG. 10 is a cross-sectional view for illustrating a state that the nozzle head is pushed down in the discharge container of Embodiment 2.

As illustrated in FIG. 10, the nozzle head C3 is further pushed down, by which the swelling portion 61*a* of the lower tube portion 67 of the stem 102 is in contact with the upper face of the lower inner tube 76 of the air piston 103 to push down the air piston 103, thereby elevating the air pressure inside the air chamber 84.

Even when the nozzle head C3 is released from being pushed down and the stem 102 and the piston guide 33 start to ascend, the air piston 103 will not ascend due to the fact that the inner circumference face of the large-diameter cylinder 15 of the cylinder member C1*a* is in contact with the sliding tube portion 75 of the air piston 103.

Then, the inner circumference face of the sealing tube 105 of the stem 102 slides on the outer circumference face of the upper inner tube 77 of the air piston 103, and the lower end of the lower inner tube 76 of the air piston 103 is in contact with the upper face of the engaging flange 53 of the piston guide 33 to block a flow channel between the air chamber 84 and the gas-liquid mixing chamber 72, thus making it possible to prevent the contained liquid and air from flowing back to the air chamber 84 from the gas-liquid mixing chamber 72.

Further, the sealing tube 105 of the stem 102 ascends, by which the sealed portion 108 of the upper outer tube 107 of the air piston 103 is separated from the diameter-expanding portion 105*a* at the lower end of the sealing tube 105 to supply air into the air chamber 84.

Other constituents are the same as those of Embodiment 1, and the same actions and effects can be obtained.

In the discharge container of the present embodiment, a sealed portion 108 is installed at the upper end of the outer circumference of the upper outer tube 107 of the air piston 103, and a diameter-expanding portion 105*a* is installed at the lower end of the sealing tube 105 of the stem 102. Moreover, since it is acceptable only that air can pass through a space between the sealing tube 105 and the upper outer tube 107 before the nozzle head C3 is pushed down, a passage groove, a notch, a tapered portion or the like may be installed anywhere at the lower end of the sealing tube 105 or at the upper end of the upper outer tube 107.

Next, an explanation will be made of Embodiment 3 of the discharge container of the present invention with reference to FIG. 11 and FIG. 12. It is to be noted that the same constituents as those of the above-described embodiments are given the same symbols or numerals, a detailed explanation of which will be omitted here.

Figure 11:
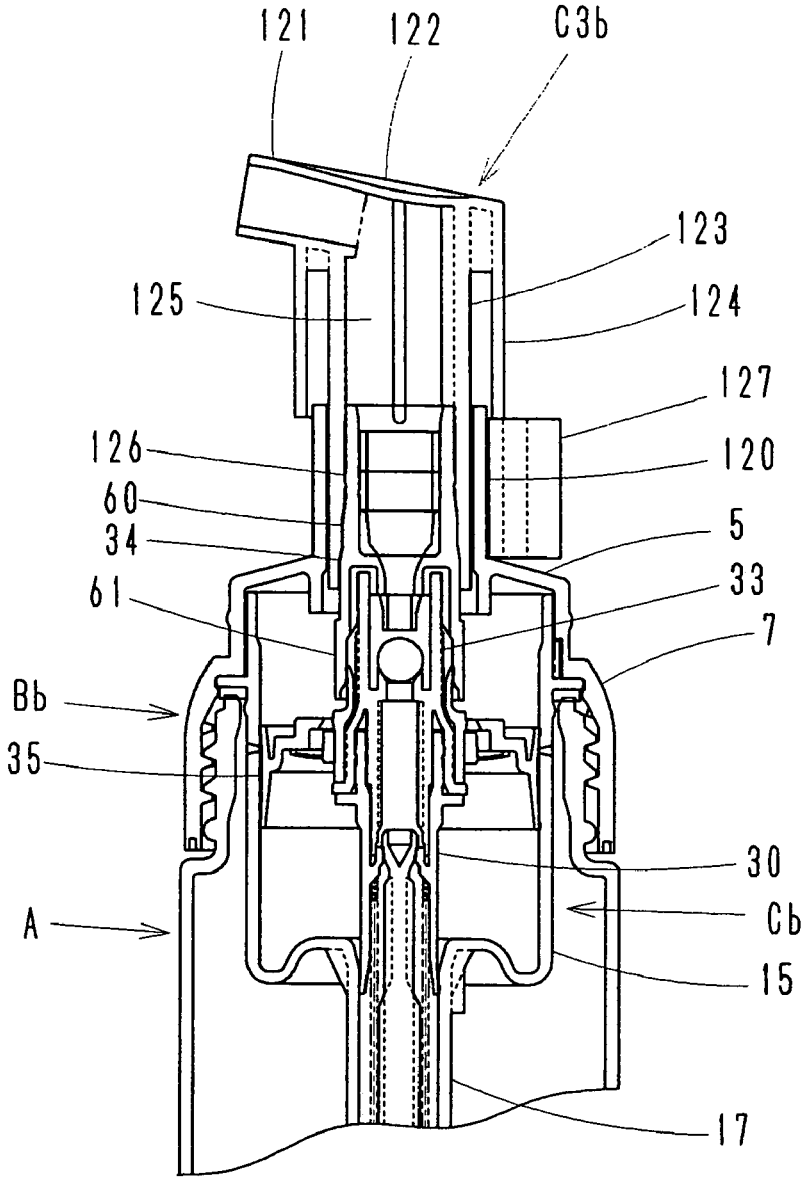
FIG. 11 is a cross-sectional view for illustrating major parts of Embodiment 3 of the discharge container of the present invention.

As illustrated in FIG. 11, the discharge container of the present embodiment is provided with a container main body A, a fixing cap Bb, and a discharge pump Cb mounted at the mouth portion of the container main body A by the fixing cap Bb.

The fixing cap Bb is provided with an upper wall 5, an inner tube 120 installed consecutively so that the inner brim of the upper wall 5 is protruded upwardly and a side circumference wall 7 installed vertically on the outer brim of the upper wall 5.

The nozzle head C3*b* of the discharge pump Cb is provided with a head portion 122, an inner tube portion 123, and an outer tube portion 124. A nozzle 121 is installed on the one side of the head portion 122. The inner tube portion 123 is installed vertically from the lower face of the head portion 122. The outer tube portion 124 is installed vertically from the lower-face outer brim of the head portion 122. A passage channel 125 continuing to the leading end of the nozzle 121 through the head portion 122 from the inner circumference of the inner tube portion 123 is formed inside the nozzle head C3*b*.

At the lower end of the inner circumference of the inner tube portion 123 installed is an engaging portion 126, which is engaged with the upper tube portion 60 of the stem 34. The outer circumference of the inner tube portion 123 is inserted into the inner circumference of the inner tube 120 of the fixing cap Bb. In assembly of the container, the upper part of the inner tube 120 of the fixing cap Bb is inserted into the inner circumference of the outer tube portion 124. A stopper 127 is fitted and inserted into the outer circumference of the inner tube 120.

Next, an explanation will be made of actions and effects of the discharge container of the present embodiment.

In the discharge container of the present embodiment, in assembly of the container, the upper part of the inner tube 120 on the fixing cap Bb is inserted into a space between the inner tube portion 123 of the nozzle head C3*b* of the discharge pump Cb and the outer tube portion 124, thus making it possible to prevent dust and water from entering into the container from the inner circumference of the inner tube 120 without using an over cap.

Other constituents are the same as those of Embodiment 1, and the same actions and effects can be obtained.

Figure 12:
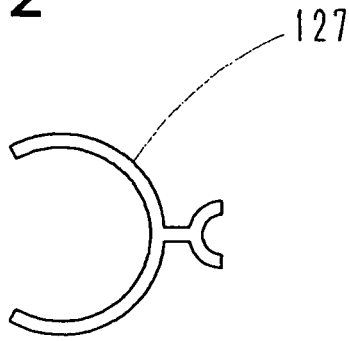
FIG. 12 is a plan view for illustrating a stopper included in the discharge container of Embodiment 3.

Further, as illustrated in FIG. 12, in the discharge container of the present embodiment, after assembly of the container, a stopper 127 for stopping the descent of the head portion 122 of the discharge pump Cb may be mounted in a removable manner on the outer circumference of the inner tube 120 of the fixing cap Bb. The stopper 127 is mounted thereon, thus making it possible to prevent the descent of the head portion 122 due to an erroneous operation.

Next, an explanation will be made of Embodiment 4 of the discharge container of the present invention with reference to FIG. 13. It is to be noted that the same constituents as those of the above-described embodiments are given the same symbols or numerals, a detailed explanation of which will be omitted.

Figure 13:
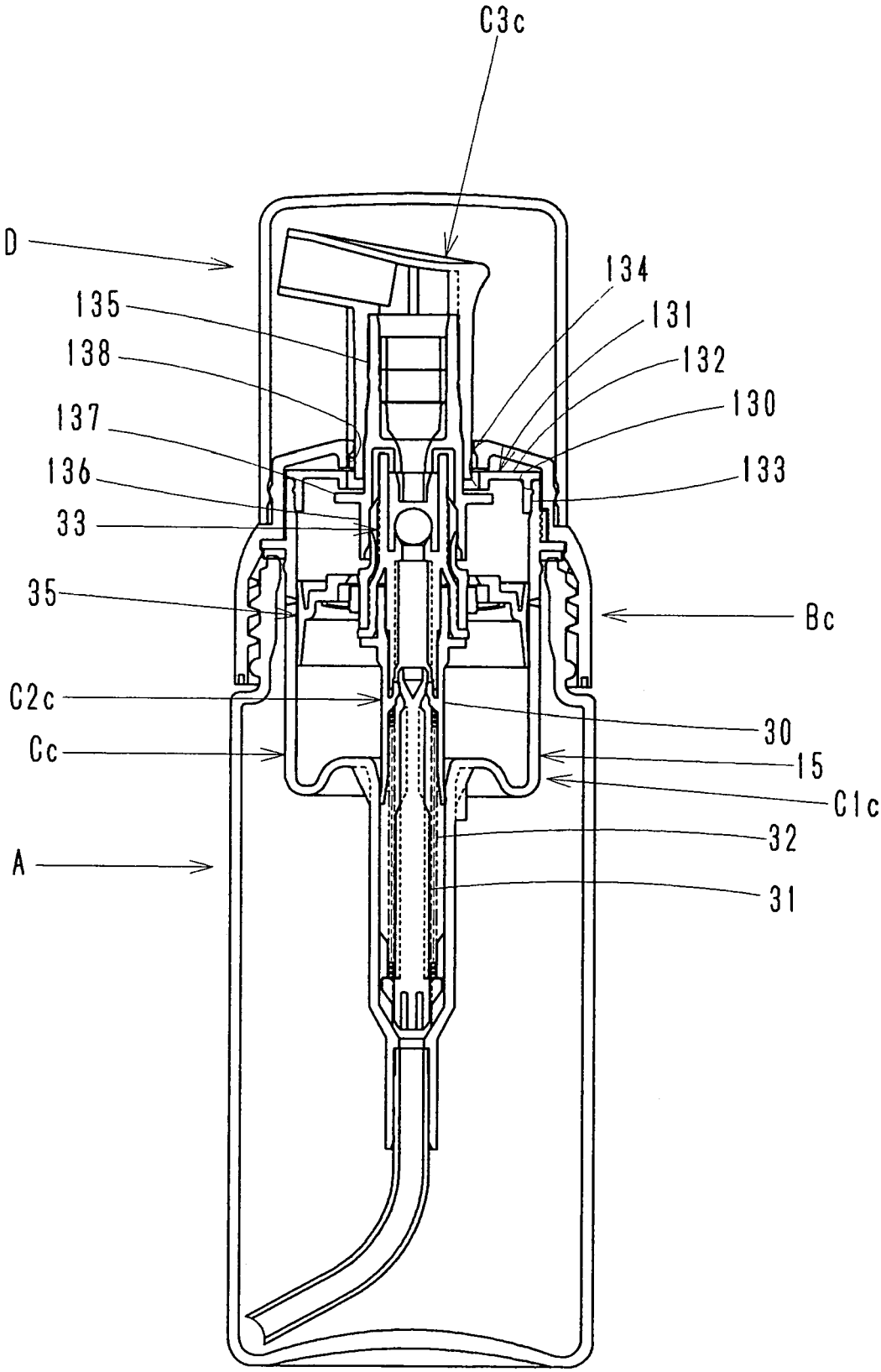
FIG. 13 is a cross-sectional view for illustrating Embodiment 4 of the discharge container of the present invention.

As illustrated in FIG. 13, the discharge container of the present embodiment is provided with a container main body A, a fixing cap Bc and a discharge pump Cc mounted at the tubular mouth portion of the container main body A by the fixing cap Bc.

The discharge pump Cc is provided with a cylinder member C1*c*, a piston member C2*c* and a nozzle head C3*c* mounted on the piston member C2*c*. An engaging portion 130 is formed at the upper end portion of the large-diameter cylinder 15 of the cylinder member C1*c*. An inner lid 131 for covering the upper face of the large-diameter cylinder 15 is fitted and attached to the engaging portion 130. The inner lid 131 is provided with an upper plate 132 joined onto the top face of the large-diameter cylinder 15, an engaging tube 133 installed vertically at the upper plate 132 and fitted into the engaging portion 130 and an inner tube 134 installed vertically from the inner circumference brim of the upper plate 132.

A flange 137 is installed at the lower tube portion 136 of the stem 135 of the piston member C2*c*. The flange 137 is in contact with the lower end of the inner tube 134 of the inner lid 131, thereby making it possible to prevent the piston member C2*c* from coming off.

The guide tube 138 of the fixing cap Bc is shorter in length than the guide tube 6 used in Embodiment 1 and arranged so as not to be in contact with the inner lid 131. However, since no problem should be posed unless it is pressed strongly to the inner lid 131, no limitation is given to the shape of the present embodiment.

Next, an explanation will be made of actions and effects of the discharge container of the present embodiment.

In assembly of the discharge pump Cc, the piston member C2*c* excluding the nozzle head C3*c* is mounted into the cylinder member C1*c*, and the inner lid 131 is then fitted and attached to the upper end of the large-diameter cylinder 15. Thereby, these components are assembled in an integrated manner. Then, the fixing cap Bc is used to mount the discharge pump Cc at a tubular mouth portion of the container main body A, thereby attaching the nozzle head C3*c*. Thus, the discharge container is assembled.

The inner lid 131 can be, therefore, used to set the cylinder member C1*c* and the piston member C2*c*, thus making it possible to easily assemble the discharge container even when the fixing cap Bc is changed.

The same actions and effects as those of Embodiment 1 can be obtained, excluding the above description.

Figure 14:
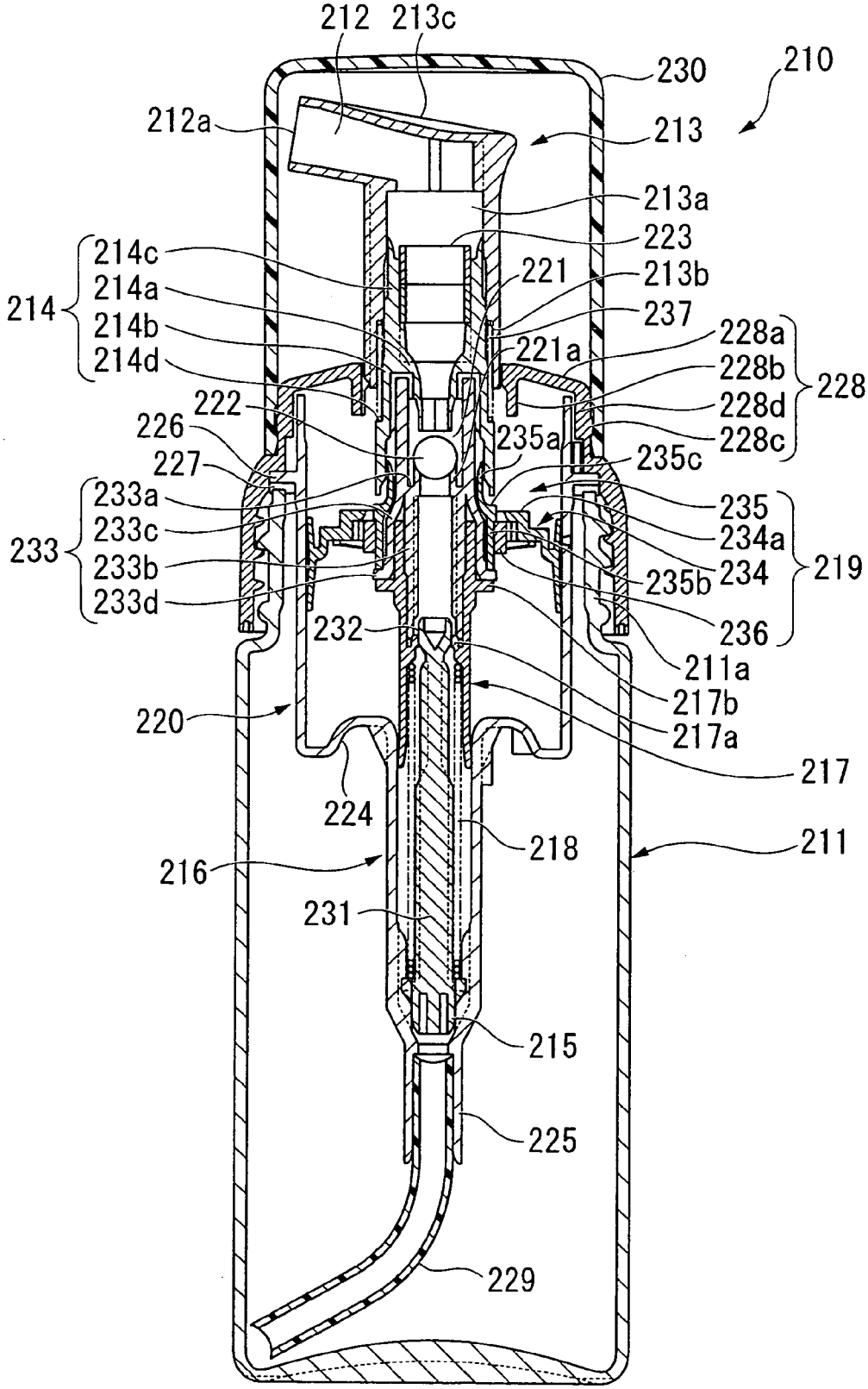
FIG. 14 is a cross-sectional view for illustrating Embodiment 5 of the discharge container of the present invention.
Figure 15:
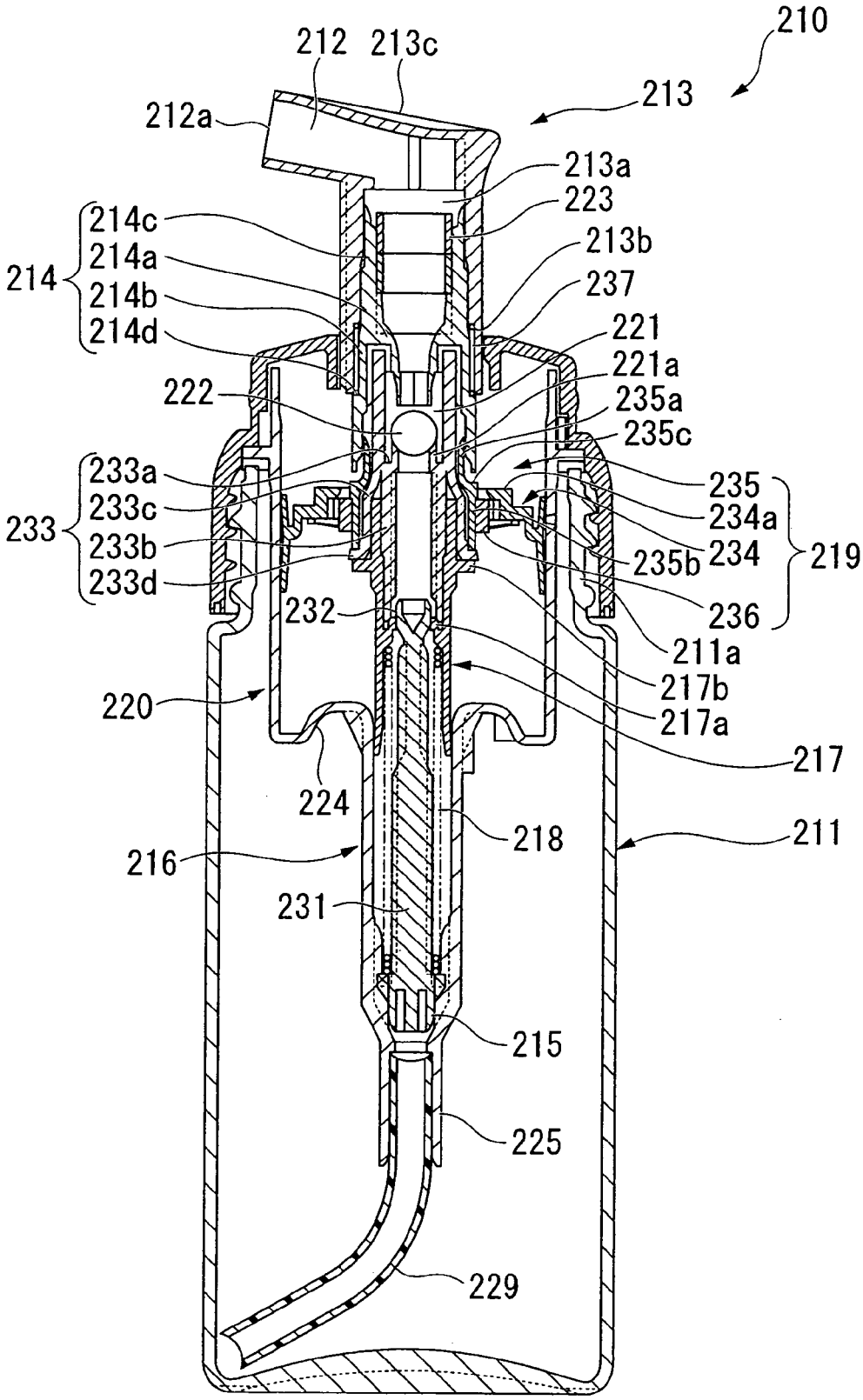
FIG. 15 is a cross-sectional view for illustrating a state that the nozzle head is pushed down and only a second coil spring is compressively deformed in the discharge container of Embodiment 5.
Figure 16:
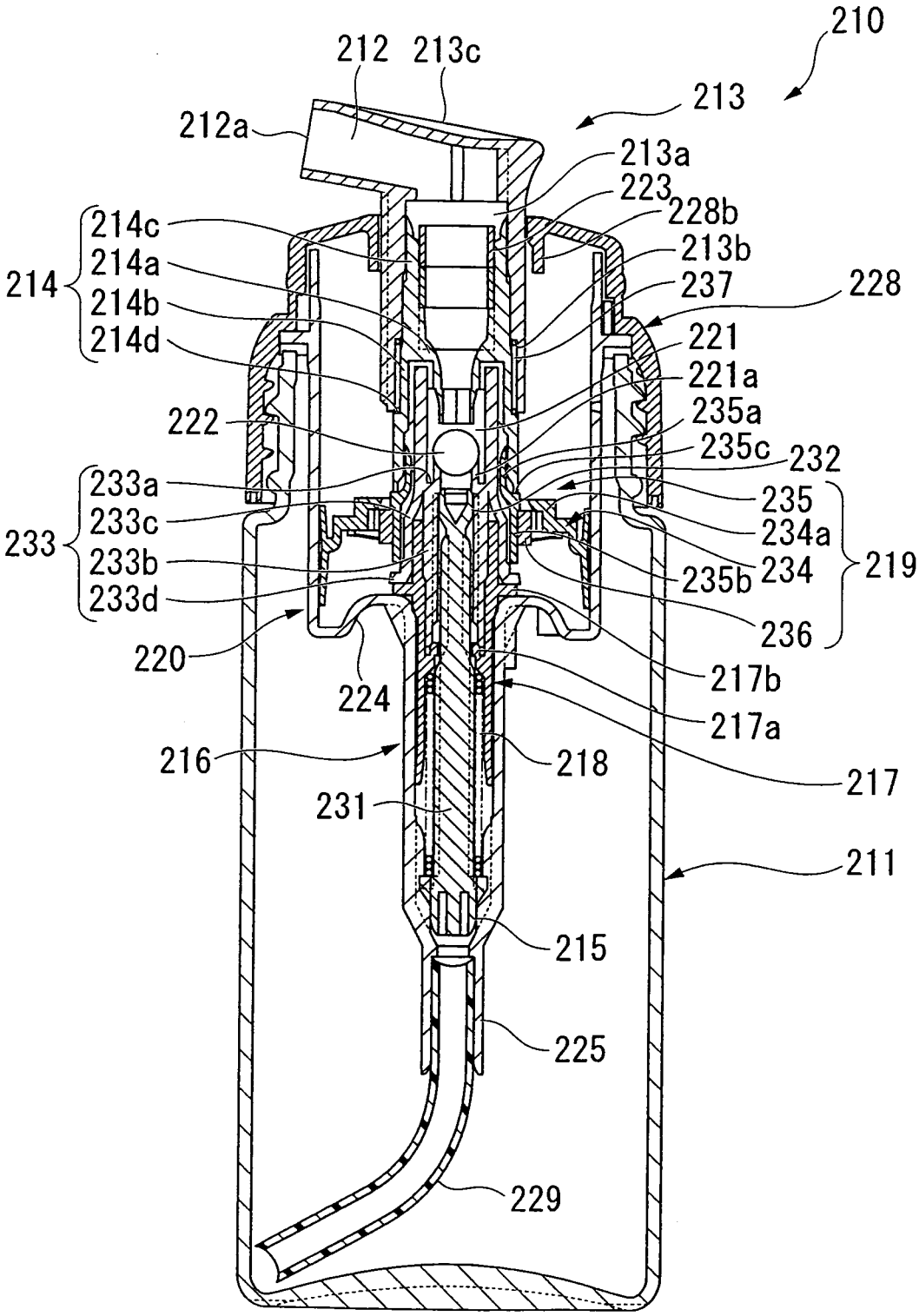
FIG. 16 is a cross-sectional view for illustrating a state that the nozzle head is pushed down and a first coil spring and the second coil spring are compressively deformed in the discharge container of Embodiment 5

Next, an explanation will be made of Embodiment 5 of the discharge container of the present invention with reference to FIG. 14 through FIG. 16.

The discharge container 210 of the present embodiment is provided with a container main body 211 and a discharge pump 213 for discharging a contained liquid from a nozzle fixed to the mouth portion 211*a* of the container main body 211. The discharge pump 213 is provided with a pushdown head (nozzle head) 213*c*, a stem 214, a cylinder for contained liquid (cylinder) 216, a lower valve member (valve member) 215, a piston for contained liquid (piston) 217 and a first coil spring (first elastic member) 218.

The pushdown head 213*c* is opened on the lower end face to have a continuous hole 213*a* communicatively connected to the nozzle hole 213 formed on a nozzle. The stem 214 is elongated from the inside of the continuous hole 213*a* below the pushdown head 213*c*. The cylinder for contained liquid 216 is formed in a tubular shape, arranged below the stem 214 and inserted into the container main body 211. The lower valve member 215 is installed at the lower-end opening portion inside the cylinder for contained liquid 216 so as to be separated from the lower-end opening portion. The piston for contained liquid 217 is installed inside the cylinder for contained liquid 216 so as to slide in a vertical direction. The first coil spring 218 is installed between the piston for contained liquid 217 and the lower valve member 215 inside the cylinder for contained liquid 216, urging the piston for contained liquid 217 upwardly.

In the discharge container of the present embodiment, the pushdown head 213*c* is pushed down, by which the piston for contained liquid 217 is pushed down, with the first coil spring 218 compressively deformed via the stem 214, and a contained liquid is discharged from the container main body 211 through the nozzle hole 212.

Further, the discharge pump 213 is provided with a cylinder for air 220, a gas-liquid mixing chamber 211, a contained liquid discharge valve 222 and a bubble foaming member 223. A piston for air 219 is arranged inside the cylinder for air 220 so as to slide freely. In the gas-liquid mixing chamber 221, a contained liquid fed from the cylinder for contained liquid 216 is merged with air fed from the cylinder for air 220. The contained liquid discharge valve 222 is installed on a valve seat 221*a* provided at a contained liquid entrance of the gas-liquid mixing chamber 221 so as to be separated from the valve seat 221*a*. The bubble foaming member 223 is installed between the nozzle hole 212 and the gas-liquid mixing chamber 221.

The discharge pump 213 is a so-called foamer pump. When the pushdown head 213*c* is pushed down, by which a contained liquid is mixed with air inside the gas-liquid mixing chamber 221, the contained liquid mixed with air is bubbled in the course of passing through the bubble foaming member 223, and the bubble-form contained liquid is discharged from a nozzle hole 212 via the continuous hole 213*a*. When the contained liquid is discharged from the nozzle hole 212, the cross-section of the flow channel of the nozzle hole 212 is filled entirely with the contained liquid. Further, the nozzle hole 212 is elongated outwardly toward the diameter of the pump from the upper end portion of the continuous hole 213*a* extending in a vertical direction.

Hereinafter, a detailed explanation will be made of the previously described individual members.

The cylinder for air 220 is elongated from the mouth portion 211*a* of the container main body 211 to the inside of the container main body 211, that is, in a downward direction. The cylinder for air 220 is larger in diameter than the cylinder for contained liquid 216. The cylinder for contained liquid 216 is extended radially and downwardly from the bottom plate portion 224 of the cylinder for air 220, and the connecting tube 225 is extended downwardly from the lower end of the cylinder for contained liquid 216. Further, a flange portion 226 is protruded on the upper outer circumference face of the cylinder for air 220.

The cylinder for air 220 is arranged inside the container main body 211 in such a manner that the flange portion 226 of the cylinder for air 220 is placed on a packing 227 disposed on the upper face of the mouth portion 211*a*. A mounting tube 228 is screwed up to the mouth portion 211*a* thereon, by which the flange portion 226 is pressed to the upper face of the mouth portion 211*a*. Thereby, the cylinder for air 220, the cylinder for contained liquid 216 and the connecting tube 225 are attached to the container main body 211. A sucking-up pump 229 is connected to the connecting tube 225. The sucking-up pump 229 is extended downwardly so that the lower-end opening portion thereof is in contact with or in close proximity to the bottom portion inside the container main body 211.

A central tube portion 228*b* is installed vertically at the central portion of the top plate portion 228*a* of the mounting tube 228 in a radial direction. A pushdown head 213*c* is arranged inside the central tube portion 228*b* so as to move in a vertical direction, and protruded above from the top plate portion 228*a*. An upper circumference wall portion 228*d* is installed vertically approximately in a downward direction from the outer circumference brim of the top plate portion 228*a* of the mounting tube 228, and a cap engaging portion 228*c*, which is engaged with the opening end portion of the over cap 230, is formed on the outer circumference face of the upper circumference wall portion 228*d*.

A shaft portion 231 is connected to the upper face of the lower valve member 215 arranged at the lower-end opening portion inside the cylinder for contained liquid 216, and an upper valve member 232 in a reverse cone shape is installed at the upper end portion of the shaft portion 213. The piston for contained liquid 217 installed inside the cylinder for contained liquid 216 so as to move in a vertical direction is a tubular body extending in a vertical direction, and a value tube portion 217*a* is installed at the central portion on the inner circumference face of the piston for contained liquid 217 in a vertical direction. A first coil spring 218 is installed between the lower face of the valve tube portion 217*a* and the upper face of the lower valve member 215 so that the shaft portion 231 is inserted thereinto. The piston for contained liquid 217 is urged by the first coil spring 218 upwardly with respect to the lower valve member 215. Thereby, in a stand-by state before the pushdown head 213*c* is pushed down, the inner circumference face of the valve tube portion 217*a* of the piston for contained liquid 217 is pressed from below down to the outer circumference face of the upper valve member 232 in a reverse cone shape, by which the inside of the cylinder for contained liquid 216 is blocked from a portion located above the valve tube portion 217*a* inside the piston for contained liquid 217.

A flange portion 217*b* is protruded on the upper outer circumference face of the piston for contained liquid 217.

When the pushdown head 213*c* is pushed down, the lower face of the flange portion 217*b* is in contact with the circumferential portion of the upper-end opening of the cylinder for contained liquid 216 on the inner face of the bottom plate portion 224 of the cylinder for air 220, thereby regulating the descent of the piston for contained liquid 217. Further, the outer circumference face of the lower end portion of the piston for contained liquid 217 is gradually expanded in diameter downwardly. When the piston for contained liquid 217 is ascended or descended inside the cylinder for contained liquid 216, the piston for contained liquid 217 slides vertically along the inner circumference face of the cylinder for contained liquid 216, while keeping a liquid-tight state.

A tubular piston guide 233 is connected to the upper part of the piston for contained liquid 217. The upper inside of the piston guide 233 is used as a gas-liquid mixing chamber 221, and the upper part of the piston for contained liquid 217 is fitted into the lower part of the piston guide 233. A step portion 233*a* in a ring shape when viewed above is installed at a central portion in a vertical direction on the inner circumference face of the piston guide 233, and a valve seat 221*a* is set upright on the inner circumference brim of the step portion 233*a*. The lower part of the piston guide 233 is provided with a double structure made up of an inner tube portion 233*b* elongated downwardly from the step portion 233*a* and a diameter-expanding tube portion 233*c* gradually expanded in diameter downwardly from the step portion 233*a*. Further, the upper part of the piston for contained liquid 217 is fitted into a space between the inner tube portion 233*b* and the diameter-expanding tube portion 233*c*. A flange portion 233*d* is installed on the outer circumference face at the lower end of the diameter-expanding tube portion 233*c*, and the lower face of the flange portion 233*d* is in contact with the upper face of the flange portion 217*b* of the piston for contained liquid 217, irrespective of whether the pushdown head 213*c* is pushed down or not.

The piston for air 219 is provided with a sliding tube portion 234, an inner tube portion 235 and an air valve 236. The sliding tube portion 234 is installed along the inner circumference face of the cylinder for air 220 so as to slide freely, while keeping a liquid-tight state in a vertical direction. The inner tube portion 235 is arranged inside a through-hole formed at the top plate portion 234*a* of the sliding tube portion 234 so as to protrude from the top plate portion 234*a* in a vertical direction. The air valve 236 is fitted into the outer circumference face of the lower part 235*b* of the inner tube portion 235. The inside of the cylinder for air 220 is divided into an upper chamber and a lower chamber by the piston for air 219, and these upper and lower chambers can be communicatively connected or blocked by the air valve 236.

The inner tube portion 235 is provided with an upper part 235*a*, a lower part 235*b* and a step portion 235*c*. The upper part 235*a* is protruded upwardly from the top plate portion 234*a* of the sliding tube portion 234. The lower part 235*b* is protruded downwardly from the top plate portion 234*a*, and the lower part 235*b* is larger in diameter than the upper part 235*a*. The step portion 235*c* connects the upper part 235*a* with the lower part 235*b*. The inner tube portion 235 is installed in such a manner that the inner circumference face of the upper part 235*a* is allowed to run along the outer circumference face of the piston guide 233 and also the inner circumference face of the lower part 235*b* is allowed to be in contact with the outer circumference face of the diameter-expanding tube portion 233*c*. The lower end of the lower part 235*b* of the inner tube portion 235 is in contact with the upper face of the flange portion 233*d* of the piston guide 233.

A partition portion 214*a* in a ring shape when viewed above is protruded at the central portion on the inner circumference face of the stem 214 in a vertical direction. The upper part of the piston guide 233 is inserted substantially across almost the entire area of the vertical direction into the lower tube portion 214*b* inside the lower tube portion 214*b* located below from the partition portion 214*a*. In a stand-by state before the pushdown head 213*c* is pushed down, the upper end portion of the inner tube portion 235 is inserted into a space between the inner circumference face of the lower end portion of the stem 214 and the outer circumference face of the upper part of the piston guide 233. The outer circumference face of the upper end portion at the inner tube portion 235 is in contact with the inner circumference face of the stem 214, with a clearance provided above from the upper end thereof. A bubble foaming member 223 is installed inside the upper tube portion 214*c* located above the partition portion 214*a* of the stem 214. A whole part of the stem 214 excluding the lower end portion is fitted into the continuous hole 213*a* of the pushdown head 213*c*.

In the above-constituted discharge container, when the pushdown head 213*c* is pushed down, the lower end of the stem 214 is in contact with the step portion 235*c* of the inner tube portion 235. Further, when the pushdown head 213*c* is pushed down, as illustrated in FIG. 16, the inner tube portion 235 descends together with a sliding tube portion 234, an air valve 236, a piston guide 233 and a piston for contained liquid 217, while a first coil spring 218 is compressively deformed. In this instance, the lower-end opening portion of the cylinder for contained liquid 216 is closed by the lower valve member 215 according to the descent of the piston for contained liquid 217. Thereby, the cylinder for contained liquid 216 is elevated in internal pressure, and the thus elevated internal pressure of the cylinder for contained liquid 216 acts on the contained liquid discharge valve 222 seated on a valve seat 221*a*, and the contained liquid discharge valve 222 is separated from the valve seat 221*a*. As a result, a contained liquid inside the cylinder for contained liquid 216 flows into the gas-liquid mixing chamber 221.

The pushdown head 213*c* is pushed down, by which air flows into the upper chamber of the cylinder for air 220 through a space between the outer circumference face of the pushdown head 213*c* and the inner circumference face of the central tube portion 228*b* of the mounting tube 228. Thereafter, the air, which has flowed into the upper chamber, passes through a clearance between the outer circumference face of the inner tube portion 235 and the through-hole of the sliding tube portion 234 and a space between the air valve 236 and the inner face of the top plate portion 234*a* of the sliding tube portion 234, flowing into the lower chamber of the cylinder for air 220. Then, the piston for air 219 descends, by which air inside the lower chamber is compressed to elevate the internal pressure of the lower chamber. The internal pressure is elevated inside the lower chamber, by which the air valve 236 is closely in contact with the inner face of the top plate portion 234*a* of the sliding tube portion 234 to stop the in-flow of air from the upper chamber to the lower chamber. Further, air inside the lower chamber flows into the gas-liquid mixing chamber 221 from a clearance between the lower end of the inner tube portion 235 and the flange portion 233*d* of the piston guide 233 through a clearance between the inner circumference face of the inner tube portion 235 and the outer circumference face of the piston guide 233. As described above, a contained liquid mixed with air inside the gas-liquid mixing chamber 221, and the thus mixed contained liquid is bubbled in the course of passing through the bubble foaming member 223, and the bubble-form contained liquid is discharged from the nozzle hole 212 via the continuous hole 213*a*.

In the present embodiment, a second coil spring (second elastic member) 237 urging the pushdown head 213*c* upwardly with respect to the stem 214 is installed between the pushdown head 213*c* and the stem 214. The second coil spring 237 is installed between the inner circumference face of the continuous hole 213*a* of the pushdown head 213*c* and the outer circumference of the stem 214. The continuous hole 213*a*, the stem 214 and the second coil spring 237 are arranged radially. A first step portion 213*b* is formed on the lower inner circumference face of the continuous hole 213*a*, and a second step portion 214*d* is formed on the lower external circumference face of the stem 214. The first step portion 213*b* is protruded to a direction orthogonal with the central axial line of the continuous hole 213*a*. The second step portion 214*d* is, as with the first step portion 213*b*, protruded to a direction orthogonal with the central axial line of the continuous hole 213*a*. The first step portion 213*b* and the second step portion 214*d* are opposed to each other along the vertical direction. The second coil spring 237 is installed so as to be held between the first step portion 213*b* and the second step portion 214*d*.

Further, in the present embodiment, the second coil spring 237 is smaller in urging force than the first coil spring 218. It is to be noted that the nozzle hole 212 may be reduced in diameter in such a manner that the passage-channel cross-section is made smaller gradually along the continuous hole 213*a* from the leading-end opening portion 212*a*.

As described so far, according to the discharge container 210 of the present embodiment, since the second coil spring 237 is installed, the pushdown head 213*c* is pushed down to discharge a contained liquid from the nozzle hole 212 of the nozzle, by which not only the first coil spring 218 but also the second coil spring 237 are compressively deformed to push down the pushdown head 213*c* to the stem 214. When the pushdown head 213*c* is released from being pushed down to return the second coil spring 237 to an original configuration, the pushdown head 213*c* is pushed upwardly to the stem 214. Therefore, it is possible to make larger the volume of an inner space continuing to the nozzle hole 212 inside the pushdown head 213*c* when the pushdown head 213*c* is released from being pushed down than that before the pushdown head 213*c* is released from being pushed down. Thereby, when the pushdown head 213*c* is released from being pushed down, the pressure is made negative inside the inner space. As a result, a contained liquid which is not discharged when the pushdown head 213*c* is pushed down but remains inside the nozzle hole 212 is sucked from the nozzle hole 212 into the inner space due to the fact that the pressure is made negative inside the inner space substantially at the same time when the pushdown head 213*c* is released from being pushed down.

According to the discharge container 210 of the present embodiment, it is possible to prevent a contained liquid from remaining inside the nozzle hole 212 after the contained liquid has been discharged and also prevent the contained liquid from dripping from the nozzle. Further, it is possible to prevent the contained liquid remaining inside the nozzle 212 from being denatured or solidified.

Since the passage-channel cross section of the nozzle hole 212 is made gradually smaller along the continuous hole 213*a* constituting the inner space from the leading-end opening portion 212*a* thereof, the pressure is made negative inside the inner space continuing to the nozzle hole 212, by which the remaining contained liquid can be more effectively sucked from the nozzle hole 212 into the inner space.

Further, in the present embodiment, the second coil spring 237 is smaller in urging force than the first coil spring 218. Therefore, when the pushdown head 213*c* is pushed down to discharge a contained liquid from the nozzle hole 212, as illustrated in FIG. 15, at first, the second coil spring 237 is compressively deformed, thereafter, as illustrated in FIG. 16, the first coil spring 218 is compressively deformed to discharge the contained liquid from the nozzle hole 212. That is, in order to discharge the contained liquid, the second coil spring 237 must be compressively deformed, thus making it possible to secure the suction when the pushdown head 213*c* is released from being pushed down.

In the discharge container of the present invention, for example, the passage-channel cross-section of the nozzle hole 212 may be made larger gradually along the continuous hole 213*a* from the leading-end opening portion 212*a* or may be the same across the entire area of the continuous hole 213*a* from the leading-end opening portion 212*a*.

Further, in the present embodiment, the second coil spring 237 is smaller in urging force than the first coil spring 218. However, for example, the first coil spring 218 may be smaller in urging force than the second coil spring 237, or they may be the same in urging force to each other.

Still further, the bubble foaming member 223 may be arranged inside the pushdown head 213*c* and the pushdown head 213*c* may be inserted into the stem 214.

In the present embodiment, an explanation has been made for the discharge container 210 as a so-called foamer pump in which a contained liquid from the nozzle hole 212 is discharged in a bubble form state. However, the discharge container of the present invention is not limited to a foamer pump but applicable, for example, to a container which is not provided with a piston for air 219, a cylinder for air 220, a gas-liquid mixing chamber 221, a bubble foaming member 223 or the like but discharging a contained liquid without bubbles.

Further, in the present embodiment, a coil spring is used as a first and a second elastic member. However, for example, soft materials such as a resin spring and a rubber member may be used as the first and the second elastic member. They may be molded separately from a pushdown head 213*c* or may be molded integrally with the pushdown head 213*c*.

As described so far, an explanation has been made for preferred embodiments of the present invention. However, the present invention shall not be limited to the above embodiments. Constituents can be added, omitted, replaced, or modified in other ways, as long as they do not deviate from the spirit of the present invention. The present invention shall not be limited by the above description but limited only by the scope of claims attached therewith.

The discharge container of the present invention can be widely used as a container for discharging the contained liquids of cosmetics, drugs or any other contained liquids.

What is claimed is:

1. A discharge container comprising a container main body, a discharge pump for discharging a contained liquid from a nozzle, and a fixing cap, wherein the discharge pump comprises a cylinder member made of a large-diameter cylinder and a small-diameter cylinder having an inlet pipe at a lower end, a piston member mounted on the cylinder member, and a nozzle head, the piston member comprises:

a piston engaged with the small-diameter cylinder internally so as to slide freely;

a poppet valve engaged with the piston;

a piston guide engaged with an upper end of the piston;

an air piston which is provided with an inner tube portion engaged with the outer circumference of the piston guide, an upper wall portion, an upper outer tube set upright at the upper wall portion and a sliding tube portion engaged with the large-diameter cylinder internally so as to slide freely, thereby forming an air chamber inside the large-diameter cylinder; and a stem which is provided with a lower tube portion engaged with an upper part of the piston guide to form a gas-liquid mixing chamber including a ball valve inside the upper part of the piston guide and engaged with the upper part of the inner tube portion so as to slide freely, an upper tube portion on which a sealing tube is installed consecutively, and a mesh ring mounted on the upper inner circumference; further wherein the nozzle head is mounted on the outer circumference of the stem;

a flange is installed on the outer circumference of the tube portion of the stem;

the sealing tube is installed vertically from the flange;

the upper outer tube having an air passage channel at an upper end of the outer circumference is set upright at the upper wall portion of the air piston;

an air hole is drilled at an upper wall portion between the upper outer tube and the inner tube portion, and the inner circumference face of a distal end of the sealing tube is slidingly in contact with the outer circumference face of a distal end of the upper outer tube according to the vertical movement of the stem, by which an air passage channel between the air chamber and the outside of a container is opened and closed.

2. The discharge container according to claim 1, wherein a vent hole is drilled in the circumference wall of the large-diameter cylinder, and the vent hole is opened and closed by the vertical movement of the sliding tube portion, thereby preventing the container main body from being made negative in pressure by the suction of a contained liquid thereinside.

3. The discharge container according to claim 1, further comprising a valve member installed at the lower-end opening portion inside the cylinder member so as to be separated from the lower-end opening portion;

a first elastic member arranged between the piston and the valve member inside the cylinder member so as to urge the piston upward;

a second elastic member for urging the nozzle head upwardly to the stem which is installed between the nozzle head and the stem.

4. The discharge container according to claim 3, wherein the nozzle is made gradually smaller in passage-channel cross-section along the continuous hole from the leading-end opening portion.

5. The discharge container according to claim 3, wherein the second elastic member is smaller in urging force than the first elastic member.

6. The discharge container according to claim 4, wherein the second elastic member is smaller in urging force than the first elastic member.

7. The discharge container according to claim 3, wherein the cylinder member is a cylinder for contained liquid and the piston is a piston for contained liquid, the discharge pump comprises a cylinder for air at which a piston for air is installed thereinside so as to slide freely;

a gas-liquid mixing chamber at which a contained liquid sent out from the cylinder member for contained liquid is merged with air sent out from the cylinder for air;

a contained liquid discharge valve is installed on a valve seat provided at a contained liquid entrance of the gas-liquid mixing chamber so as to be separated from the valve seat;

the mesh ring is a bubble foaming member that is installed between the nozzle and the gas-liquid mixing chamber; and the nozzle head is pushed down, by which a contained liquid inside the container main body is merged with air inside the gas-liquid mixing chamber and the contained liquid merged with air is bubbled in the course of passing through the bubble foaming member, thereby discharging the thus bubbled contained liquid from the nozzle.

8. The discharge container according to claim 4, wherein the cylinder member is a cylinder for contained liquid and the piston is a piston for contained liquid, the discharge pump comprises a cylinder for air at which a piston for air is installed thereinside so as to slide freely;

a gas-liquid mixing chamber at which a contained liquid sent out from the cylinder member for contained liquid is merged with air sent out from the cylinder for air;

a contained liquid discharge valve is installed on a valve seat provided at a contained liquid entrance of the gas-liquid mixing chamber so as to be separated from the valve seat;

the mesh ring is a bubble foaming member that is installed between the nozzle and the gas-liquid mixing chamber; and the nozzle head is pushed down, by which a contained liquid inside the container main body is merged with air inside the gas-liquid mixing chamber and the contained liquid merged with air is bubbled in the course of passing through the bubble foaming member, thereby discharging the thus bubbled contained liquid from the nozzle.

9. The discharge container according to claim 5 wherein the cylinder member is a cylinder for contained liquid and the piston is a piston for contained liquid, the discharge pump comprises a cylinder for air at which a piston for air is installed thereinside so as to slide freely;

a gas-liquid mixing chamber at which a contained liquid sent out from the cylinder member for contained liquid is merged with air sent out from the cylinder for air;

a contained liquid discharge valve is installed on a valve seat provided at a contained liquid entrance of the gas-liquid mixing chamber so as to be separated from the valve seat;

the mesh ring is a bubble foaming member that is installed between the nozzle and the gas-liquid mixing chamber; and the nozzle head is pushed down, by which a contained liquid inside the container main body is merged with air inside the gas-liquid mixing chamber and the contained liquid merged with air is bubbled in the course of passing through the bubble foaming member, thereby discharging the thus bubbled contained liquid from the nozzle.

10. The discharge container according to claim 6 wherein the cylinder member is a cylinder for contained liquid and the piston is a piston for contained liquid, the discharge pump comprises a cylinder for air at which a piston for air is installed thereinside so as to slide freely;

a gas-liquid mixing chamber at which a contained liquid sent out from the cylinder member for contained liquid is merged with air sent out from the cylinder for air;

a contained liquid discharge valve is installed on a valve seat provided at a contained liquid entrance of the gas-liquid mixing chamber so as to be separated from the valve seat;

the mesh ring is a bubble foaming member that is installed between the nozzle and the gas-liquid mixing chamber; and the nozzle head is pushed down, by which a contained liquid inside the container main body is merged with air inside the gas-liquid mixing chamber and the contained liquid merged with air is bubbled in the course of passing through the bubble foaming member, thereby discharging the thus bubbled contained liquid from the nozzle.

* * * * *